US012317949B2

(12) United States Patent
Johnson et al.

(10) Patent No.: US 12,317,949 B2
(45) Date of Patent: Jun. 3, 2025

(54) ARTICLE OF FOOTWEAR

(71) Applicant: PUMA SE, Herzogenaurach (DE)

(72) Inventors: Charles Johnson, Nuremberg (DE); Romain Girard, Lauf an der Pegnitz (DE); Arnaud Redon, Nuremberg (DE)

(73) Assignee: PUMA SE, Herzogenaurach (DE)

( * ) Notice: Subject to any disclaimer, the term of this patent is extended or adjusted under 35 U.S.C. 154(b) by 819 days.

(21) Appl. No.: 17/538,368

(22) Filed: Nov. 30, 2021

(65) Prior Publication Data

US 2022/0087366 A1 Mar. 24, 2022

Related U.S. Application Data

(63) Continuation of application No. 16/546,148, filed on Aug. 20, 2019, now Pat. No. 11,185,127.

(51) Int. Cl.
*A43B 13/14* (2006.01)
*A43B 1/04* (2022.01)
(Continued)

(52) U.S. Cl.
CPC ..... *A43B 1/04* (2013.01); *A43B 3/0036* (2013.01); *A43B 7/14* (2013.01); *A43B 13/14* (2013.01);
(Continued)

(58) Field of Classification Search
CPC ..... A47C 3/029; A47C 15/004; A43B 13/145; A43B 13/146; A43B 13/148
See application file for complete search history.

(56) References Cited

U.S. PATENT DOCUMENTS 2,147,197 A 2/1939 Glidden
2,586,045 A 2/1952 Hoza
(Continued)

FOREIGN PATENT DOCUMENTS

CN 304186109 6/2017
EP 2904920 A2 8/2015
(Continued)

OTHER PUBLICATIONS

International Search Report and Written Opinion of the International Searching Authority from corresponding PCT Application No. PCT/IB2020/057807, dated Nov. 25, 2020 (16 pages).

*Primary Examiner* — Marie D Bays
(74) *Attorney, Agent, or Firm* — Quarles & Brady LLP

(57) ABSTRACT

A method for using an article of footwear while sitting in a chair capable of transitioning between at least first, second, and third states. The article of footwear includes an outsole. The outsole includes a medial wrap-up, a lateral wrap-up, and a heel wrap-up. The method includes positioning the article of footwear in a first footwear state while sitting in a chair first state. The method further includes positioning the article of footwear in a second footwear state while sitting in a chair second state. When in the second footwear state, the medial wrap-up deforms relative to the first footwear state. The method further includes positioning the article of footwear in a third footwear state while sitting in a chair third state. When in the third footwear state, the heel wrap-up deforms relative to the first footwear state.

18 Claims, 20 Drawing Sheets

(51) Int. Cl.

| | |
|---|---|
| ***A43B 3/00*** | (2022.01) |
| ***A43B 7/14*** | (2022.01) |
| ***A43B 23/02*** | (2006.01) |
| ***A47C 3/029*** | (2006.01) |
| ***A47C 15/00*** | (2006.01) |

(52) U.S. Cl.

CPC ..... *A43B 13/145* (2013.01); *A43B 23/0205* (2013.01); *A43B 23/0245* (2013.01); *A47C 3/029* (2013.01); *A47C 15/004* (2013.01)

(56) References Cited

U.S. PATENT DOCUMENTS

| | | | | |
|---|---|---|---|---|
| 3,075,810 | A * | 1/1963 | Kitsopoulos | A47C 7/543 297/131 |
| 4,155,180 | A * | 5/1979 | Phillips | A43B 13/145 36/43 |
| 4,276,671 | A | 7/1981 | Melton | |
| 4,455,767 | A | 6/1984 | Bergmans | |
| 4,541,186 | A | 9/1985 | Mulvihill | |
| 4,542,598 | A | 9/1985 | Misevich et al. | |
| D347,518 | S | 6/1994 | Stewart | |
| 5,317,819 | A | 6/1994 | Ellis, III | |
| D348,351 | S | 7/1994 | Orzeck | |
| 5,375,911 | A * | 12/1994 | Morrow | A47C 3/029 297/DIG. 10 |
| 5,448,839 | A * | 9/1995 | Blissett | A43B 13/38 36/144 |
| 5,507,106 | A * | 4/1996 | Fox | A43B 13/143 36/114 |
| 5,974,699 | A * | 11/1999 | Park | A43B 13/148 36/103 |
| D425,290 | S | 5/2000 | Matis | |
| 6,260,289 | B1 * | 7/2001 | Tsuji | A43B 13/145 36/31 |
| 6,308,438 | B1 | 10/2001 | Throneburg et al. | |
| D450,180 | S | 11/2001 | Matis et al. | |
| D458,443 | S | 6/2002 | Matis | |
| 6,789,331 | B1 * | 9/2004 | Ellis, III | A43B 13/12 36/114 |
| D498,574 | S | 11/2004 | Issler | |
| D502,309 | S | 3/2005 | Belley et al. | |
| D514,297 | S | 2/2006 | Matis et al. | |
| D517,297 | S | 3/2006 | Jones et al. | |
| D539,018 | S | 3/2007 | Belley et al. | |
| D584,497 | S | 1/2009 | Banik | |
| D594,208 | S | 6/2009 | Banik et al. | |
| 8,549,774 | B2 | 10/2013 | Meschter et al. | |
| 8,622,473 | B2 * | 1/2014 | Walsh | A47C 3/029 297/451.3 |
| 8,770,664 | B1 * | 7/2014 | Leal | A47C 3/029 297/344.1 |
| D731,763 | S | 6/2015 | Solstad | |
| 9,204,687 | B1 | 12/2015 | Piontkowski et al. | |
| 9,668,583 | B2 * | 6/2017 | Warncke | A47C 3/029 |
| D801,664 | S | 11/2017 | Small | |
| D805,742 | S | 12/2017 | Ochipa et al. | |
| D809,265 | S | 2/2018 | Boys et al. | |
| D824,155 | S | 7/2018 | Maulid | |
| D834,294 | S | 11/2018 | Small | |
| D841,973 | S | 3/2019 | Small | |
| 10,231,512 | B2 | 3/2019 | Lucca | |
| D846,840 | S | 4/2019 | Howe | |
| D851,377 | S | 6/2019 | Caruso et al. | |
| D873,543 | S | 1/2020 | Coonrod et al. | |
| D874,119 | S | 2/2020 | Howe | |
| D874,123 | S | 2/2020 | Cin | |
| D878,014 | S | 3/2020 | Chen | |
| D884,315 | S | 5/2020 | Chen | |
| D887,110 | S | 6/2020 | Rasmussen | |
| D891,071 | S | 7/2020 | Swierszczyk et al. | |
| D901,865 | S | 11/2020 | Cruz | |
| D902,537 | S | 11/2020 | Lin et al. | |
| 2002/0014021 | A1 * | 2/2002 | Ellis, III | A43B 13/146 36/25 R |
| 2002/0017036 | A1 * | 2/2002 | Berger | A43B 13/186 36/31 |
| 2004/0118018 | A1 | 6/2004 | Dua | |
| 2004/0154188 | A1 | 8/2004 | Laska | |
| 2005/0166427 | A1 | 8/2005 | Greene et al. | |
| 2006/0195971 | A1 | 9/2006 | Lambertz | |
| 2007/0240332 | A1 * | 10/2007 | Ellis, III | A43B 13/143 36/30 R |
| 2009/0085386 | A1 * | 4/2009 | McCoy | A47C 3/029 297/344.21 |
| 2011/0140492 | A1 * | 6/2011 | Walsh | A47C 3/021 297/271.6 |
| 2011/0203137 | A1 | 8/2011 | Long et al. | |
| 2013/0269209 | A1 | 10/2013 | Lang et al. | |
| 2014/0047740 | A1 * | 2/2014 | Tucker | A43B 13/223 36/83 |
| 2014/0059886 | A1 | 3/2014 | Lyttle et al. | |
| 2014/0150292 | A1 | 6/2014 | Podhajny et al. | |
| 2015/0135558 | A1 | 5/2015 | Inomata et al. | |
| 2015/0143720 | A1 | 5/2015 | Avar | |
| 2015/0282565 | A1 | 10/2015 | Kilgore | |
| 2016/0278471 | A1 | 9/2016 | Rossignoli et al. | |
| 2017/0035143 | A1 | 2/2017 | Sato et al. | |
| 2017/0280823 | A1 * | 10/2017 | Langvin | A43B 9/12 |
| 2018/0008006 | A1 | 1/2018 | Boys et al. | |
| 2018/0317592 | A1 | 11/2018 | Rudolf et al. | |
| 2018/0317605 | A1 | 11/2018 | Bastianelli et al. | |
| 2019/0029368 | A1 | 1/2019 | Crumbleholme | |
| 2019/0150563 | A1 | 5/2019 | Shorten | |
| 2019/0335857 | A1 | 11/2019 | Huffa et al. | |
| 2019/0365044 | A1 * | 12/2019 | Cross | A43B 13/12 |
| 2020/0029647 | A1 | 1/2020 | Unnewehr et al. | |
| 2020/0297069 | A1 | 9/2020 | Bell et al. | |
| 2020/0305544 | A1 | 10/2020 | Cross | |
| 2020/0390185 | A1 | 12/2020 | Howe | |

FOREIGN PATENT DOCUMENTS

| | | | |
|---|---|---|---|
| EP | 3001920 | A1 | 4/2016 |
| WO | 2015076875 | A1 | 5/2015 |
| WO | 2015076893 | A1 | 5/2015 |
| WO | 2016167899 | A1 | 10/2016 |

* cited by examiner

ARTICLE OF FOOTWEAR

CROSS REFERENCE TO RELATED APPLICATIONS

The present application is a continuation of U.S. patent application Ser. No. 16/546,148 filed on Aug. 20, 2019, which is incorporated herein by reference in its entirety.

REFERENCE REGARDING FEDERALLY SPONSORED RESEARCH OR DEVELOPMENT

Not applicable

SEQUENCE LISTING

Not applicable

BACKGROUND

1. Field of the Invention

The present disclosure relates generally to an article of footwear intended for indoor activities.

2. Description of the Background

Typically, shoes are worn in outdoor environments. For example, an individual may wear shoes to walk outside, at work, to play sports, to go shopping, etc. While inside, an individual may opt to be barefoot; however, for added warmth and/or comforter, an individual may opt to wear slippers or socks. Conventional socks are commonly formed from a tubular section of knit fabric that is configured to conform to a foot. Therefore, conventional socks are comfortable, but do not provide any support or stability. Further, conventional socks can be slippery on various floor surfaces, such as hardwood floors. Therefore, a need exists for an article of footwear intended to provide stability, support, and grip while worn indoors.

SUMMARY

In one aspect, a method for using an article of footwear while sitting in a chair capable of transitioning between at least first, second, and third states is disclosed. An orientation of the chair may be different in each of the at least first, second, and third states. The article of footwear may comprise an outsole. The outsole may include a medial wrap-up, a lateral wrap-up, and a heel wrap-up. The method may include positioning the article of footwear in a first footwear state while sitting in a chair first state. The method may further include positioning the article of footwear in a second footwear state while sitting in a chair second state. When in the second footwear state, the medial wrap-up may deform relative to the first footwear state. The method may further include positioning the article of footwear in a third footwear state while sitting in a chair third state. When in the third footwear state, the heel wrap-up may deform relative to the first footwear state.

In another aspect, a method for using an article of footwear that includes an outsole is disclosed. The outsole may include a medial wrap-up, a lateral wrap-up, and a heel wrap-up. The method may include positioning the article of footwear in a first footwear state. The method may include positioning the article of footwear in a second footwear state. When in the second footwear state, the medial wrap-up may receive increased force, relative to the first footwear state. The method may further include positioning the article of footwear in a third footwear state. When in the third footwear state, the heel wrap-up may receive increased force, relative to the first footwear state. When the article of footwear is in the first footwear state, the lateral wrap-up may receive increased force, relative to the second footwear state. The outsole may further include a forefoot support surface, a heel support surface, and a midfoot bridge. The midfoot bridge may connect the forefoot support surface and the heel support surface. The midfoot bridge may be positioned proximate a medial side of the article of footwear.

In still another aspect, a system for use with electronic gaming is disclosed. The system may include a gaming chair. The gaming chair may include a seat, a first leg, and a second leg. The first and second legs may extend from the seat. The first leg may include a first portion, a second portion, and a third portion. A first curved portion may connect the first portion to the second portion. A second curved portion may connect the second portion to the third portion. The system may further include an article of footwear that includes an outsole. The outsole may include a medial wrap-up, a lateral wrap-up, and a heel wrap-up.

In yet another aspect, a method for using an article of footwear that includes an outsole is disclosed. The outsole may include a medial wrap-up, a lateral wrap-up, and a heel wrap-up. The method may include positioning the article of footwear in a first footwear state. The method may include positioning the article of footwear in a second footwear state. When in the second footwear state, the medial wrap-up may deform, relative to the first footwear state. The method may include positioning the article of footwear in a third footwear state. When in the third footwear state, the heel wrap-up may deform, relative to the first footwear state. When the article of footwear is in the first footwear state, the lateral wrap-up may deform, relative to the second footwear state. The outsole may further include a forefoot support surface, a heel support surface, and a midfoot bridge. The midfoot bridge may connect the forefoot support surface and the heel support surface. The midfoot bridge may be positioned proximate a medial side of the article of footwear.

Other aspects of the systems and methods described herein, including features and advantages thereof, will become apparent to one of ordinary skill in the art upon examination of the figures and detailed description herein. Therefore, all such aspects of the systems and methods are intended to be included in the detailed description and this summary.

DETAILED DESCRIPTION OF THE DRAWINGS

Figure 1:
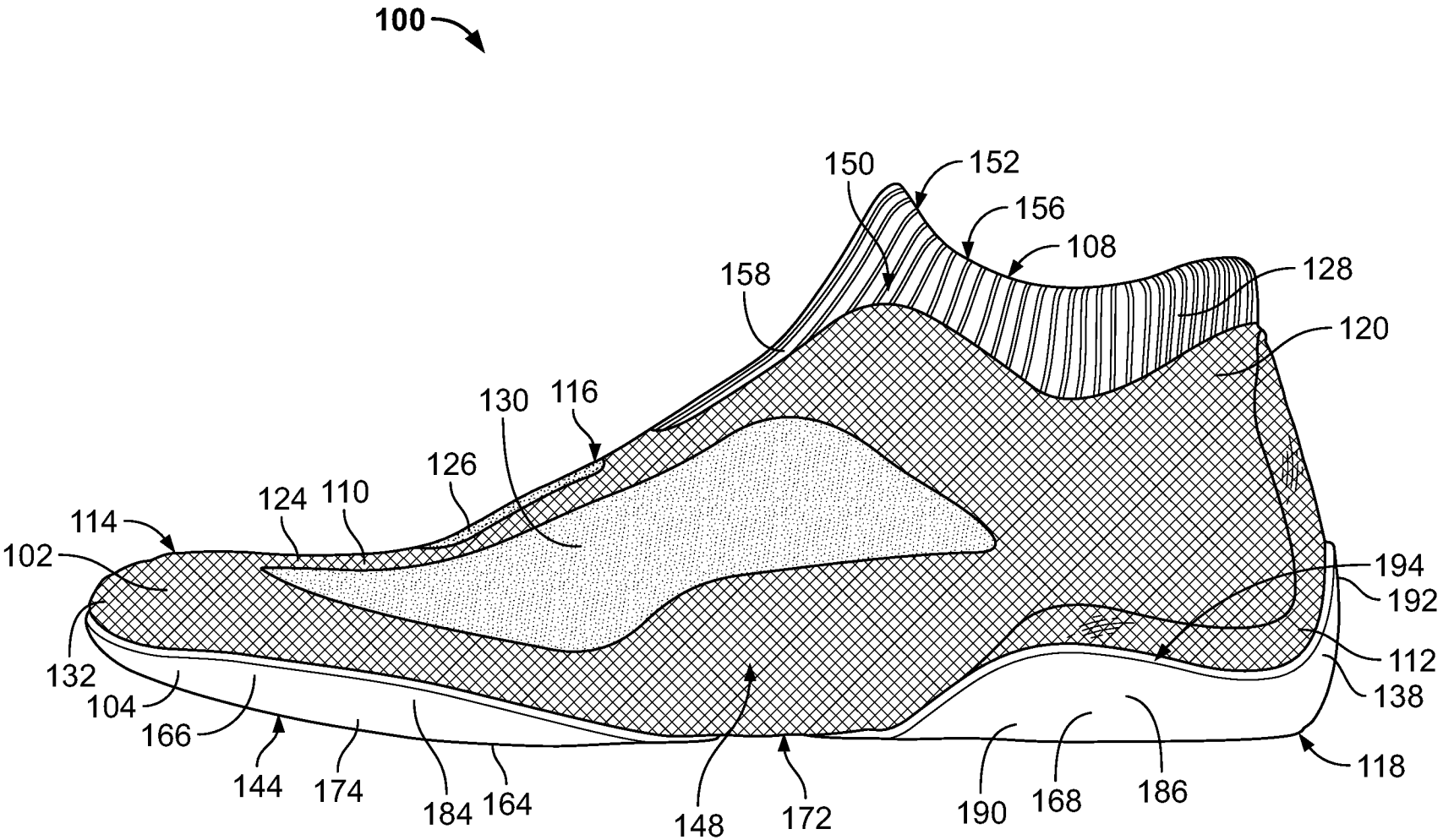
FIG. 1 is a left elevation view of an article of footwear according to a first embodiment.

The following discussion and accompanying figures disclose various embodiments or configurations of an article of footwear generally, and a sock more specifically, intended for indoor activities. Although embodiments are disclosed with reference to a sock intended for generally sedentary and indoor use, such as gaming activities, concepts associated with embodiments of the sock may be applied to a wide range of footwear and footwear styles, including athletic and outdoor activities, such as walking shoes, gardening shoes, cross-training shoes, weightlifting shoes, yoga footwear, and pool shoes, for example. Concepts of the sock may also be applied to articles of footwear that are considered non-athletic, including dress shoes, sandals, loafers, slippers, and heels. Accordingly, concepts described herein may be utilized in a variety of products.

The article of footwear may be configured to deliver enhanced support and stability to a user during indoor activities. For example, the article of footwear may ensure a foot of the user does not slip while the user plays video games. Currently, individuals who play video games commonly wear conventional socks. However, conventional socks provide significant drawbacks. For example, if a user wears socks while sitting, feet of the user may easily slip and slide if the user presses the feet into a ground surface, such as hardwood floor, cement, or carpet. Further, socks provide no support or stability to the foot. Therefore, a need exists for a comfortable indoor sock that can provide enhanced support, stability, and grip.

The terms "about" and "approximately," as used herein, refer to variation in the numerical quantity that may occur, for example, through typical measuring and manufacturing procedures used for articles of footwear or other articles of manufacture that may include embodiments of the disclosure herein; through inadvertent error in these procedures; through differences in the manufacture, source, or purity of the ingredients used to make the compositions or mixtures or carry out the methods; and the like. Throughout the disclosure, the terms "about" and "approximately" refer to a range of values±5% of the numeric value that the term precedes.

The present disclosure is directed to an article of footwear and/or specific components of the article of footwear, such as an upper and/or a sole or sole structure. The upper may comprise a knitted component, a woven textile, a non-woven textile, leather, mesh, suede, and/or a combination of one or more of the aforementioned materials. The knitted component may be made by knitting of yarn, the woven textile by weaving of yarn, and the non-woven textile by manufacture of a unitary non-woven web. Knitted textiles include textiles formed by way of warp knitting, weft knitting, flat knitting, circular knitting, and/or other suitable knitting operations. The knit textile may have a plain knit structure, a mesh knit structure, and/or a rib knit structure, for example. Woven textiles include, but are not limited to, textiles formed by way of any of the numerous weave forms, such as plain weave, twill weave, satin weave, dobbin weave, jacquard weave, double weaves, and/or double cloth weaves, for example. Non-woven textiles include textiles made by air-laid and/or spun-laid methods, for example. The upper may comprise a variety of materials, such as a first yarn, a second yarn, and/or a third yarn, which may have varying properties and/or varying visual characteristics. Further, the upper may be constructed from a tubular piece of fabric or a flat pattern of fabric.

Figure 2:
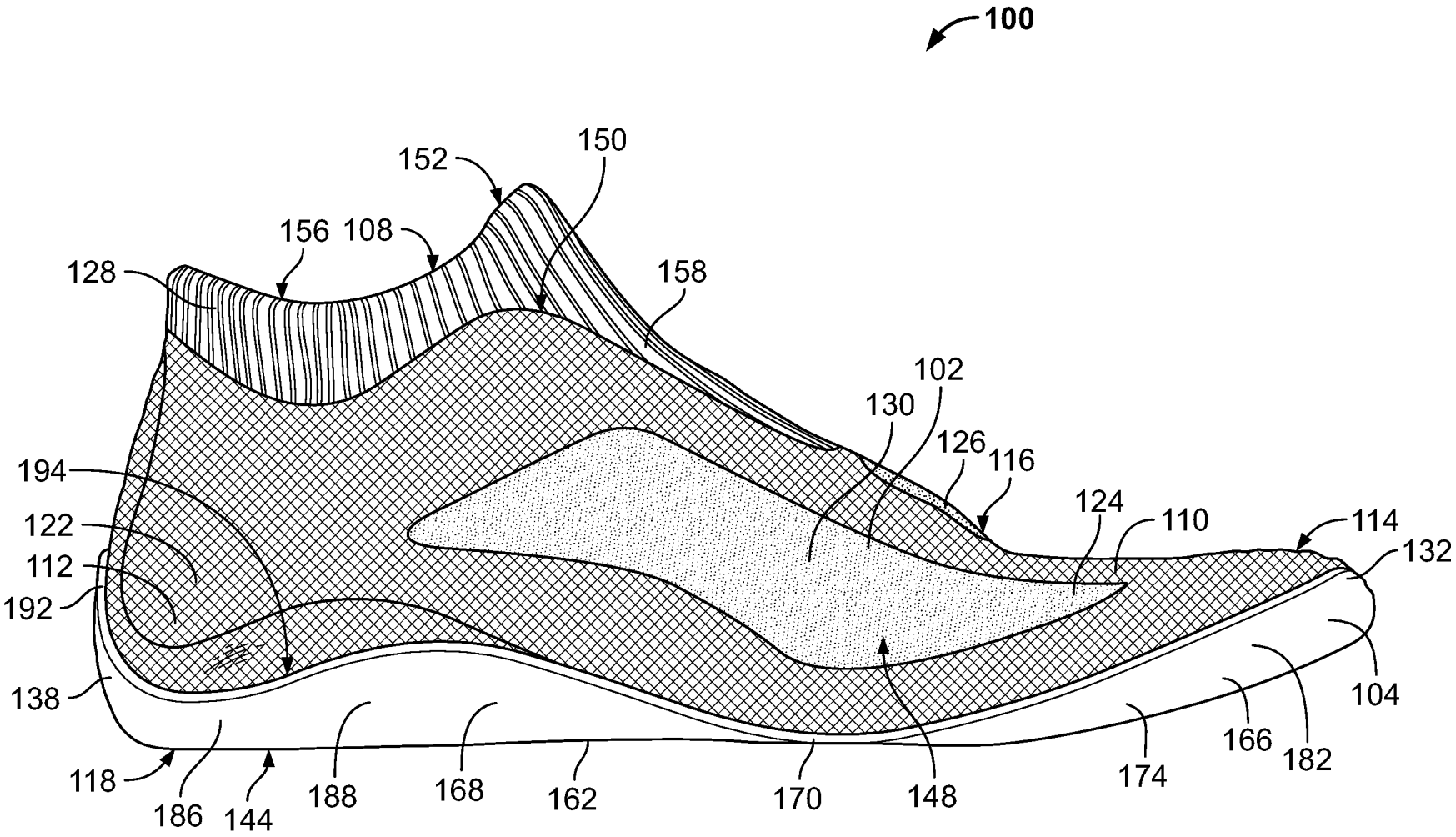
FIG. 2 is a right elevation view of the article of footwear of FIG. 1.
Figure 3:
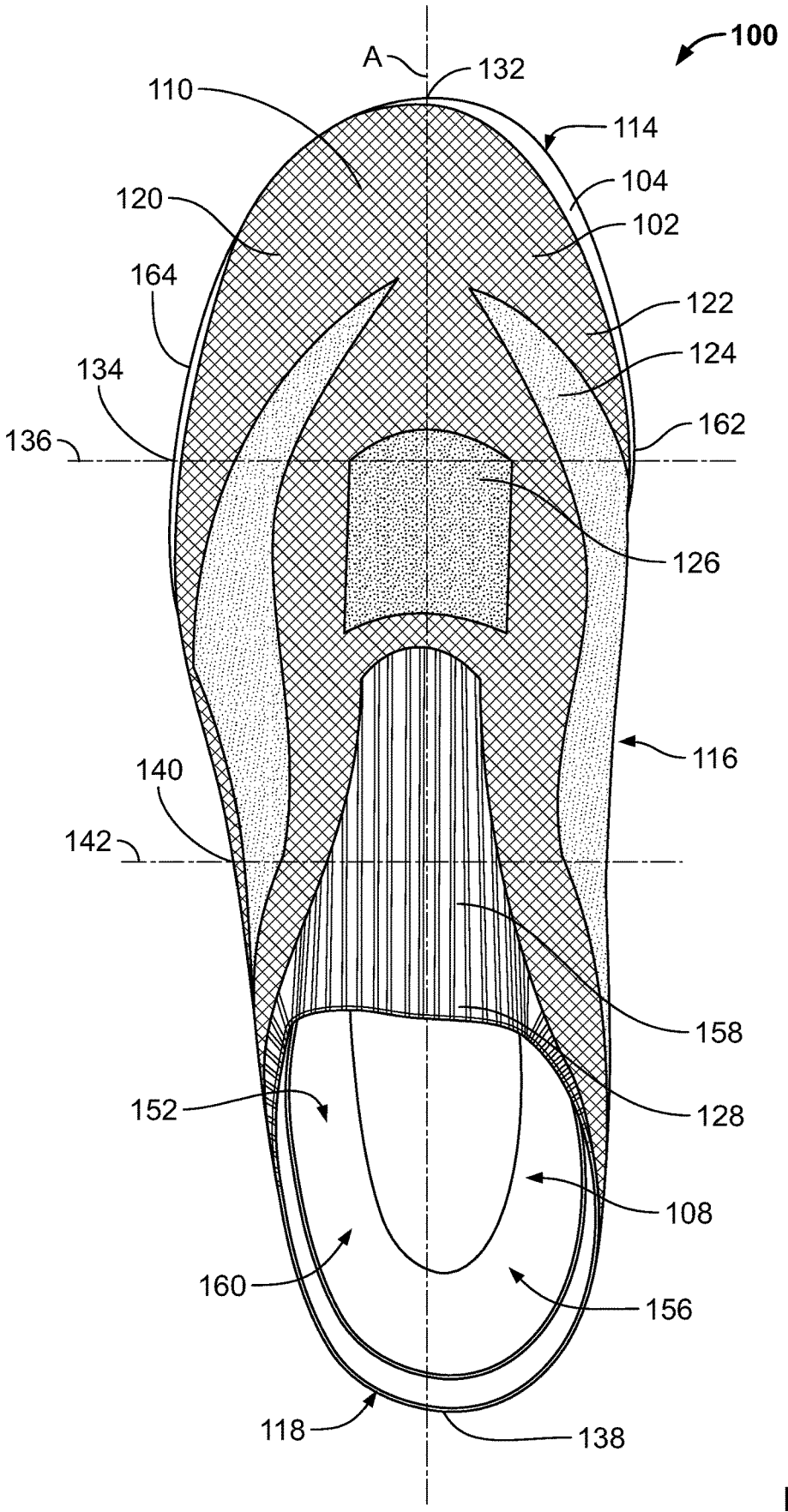
FIG. 3 is a top perspective view of the article of footwear of FIG. 1.
Figure 6:
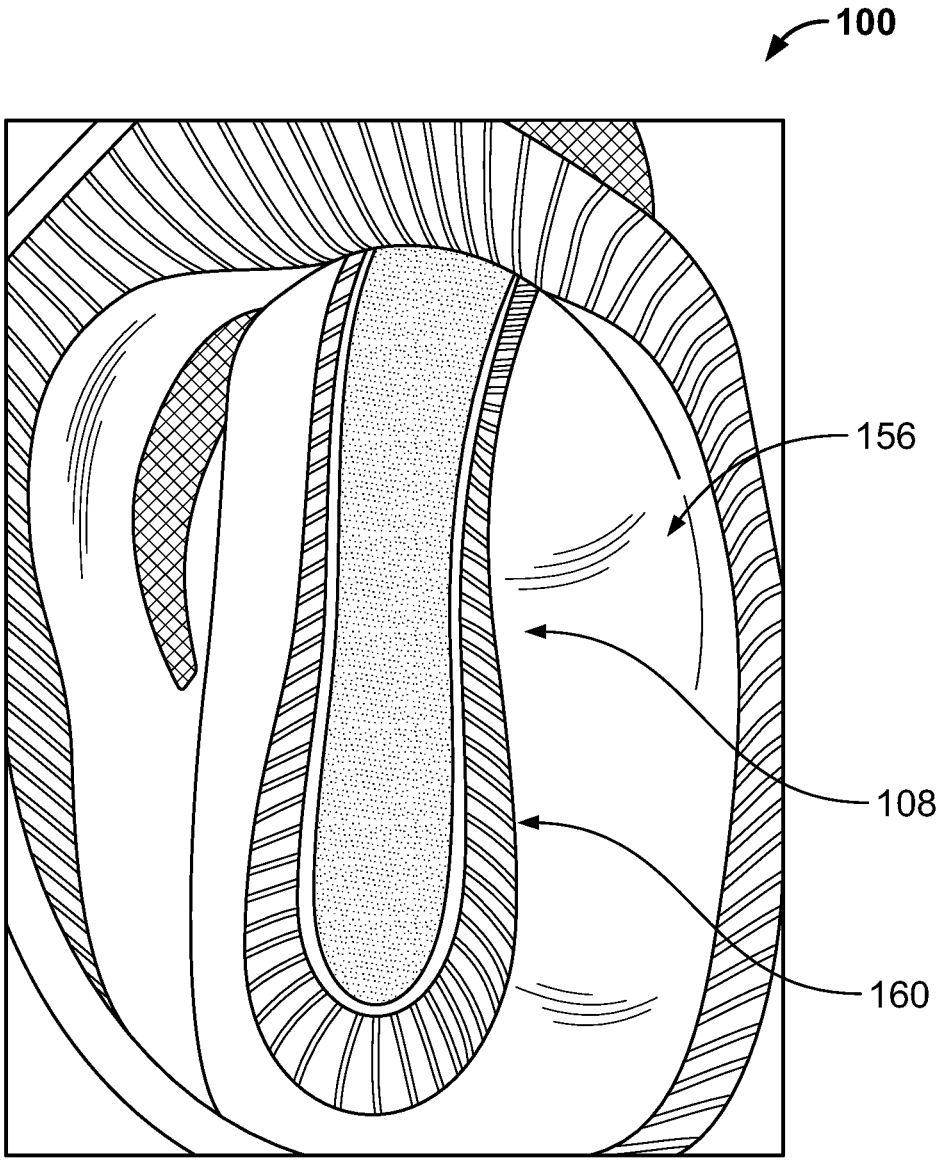
FIG. 6 is a detail view of an insole region and an interior of the upper of the article of footwear of FIG. 1.

FIGS. 1-3 depict an article of footwear 100 that may include an upper 102 and an outsole 104. The upper 102 may be a tubular component that defines an interior cavity 108 (see FIGS. 3 and 6) into which a foot of a user may be inserted. In some embodiments, an additional skin layer 112, which will be described later, may be disposed between and attached to the upper 102 and the outsole 104. The article of footwear 100 may be a component in an assembly that includes additional components such as those discussed in greater detail herein. It should be understood that the article of footwear 100 of FIG. 1, and any other embodiments disclosed herein, may be provided individually or in a pair. More specifically, it should be understood that the article of footwear 100 is a left sock that may be accompanied by a right sock when worn. The left sock and the right sock may be similar in all material aspects, except that the left sock and the right sock are sized and shaped to receive a left foot and a right foot of a user, respectively. For ease of disclosure, a single sock will be referenced to describe the article of footwear 100 according to aspects of the present disclosure, and it should be understood that that disclosure is applicable to both a left sock and a right sock.

The article of footwear 100 defines a forefoot region 114, a midfoot region 116, and a heel region 118. The forefoot region 114 generally corresponds with portions of the article of footwear 100 that encase portions of a foot that include the toes, the ball of the foot, and joints connecting the metatarsals with the toes or phalanges. The midfoot region 116 is proximate and adjoining the forefoot region 114, and generally corresponds with portions of the article of footwear 100 that encase the arch of a foot, along with the bridge of a foot (i.e., the metatarsals). The heel region 118 is proximate and adjoining the midfoot region 116 and generally corresponds with portions of the article of footwear 100 that encase rear portions of the foot, including the heel or calcaneus bone, the ankle, and/or the Achilles tendon. Furthermore, the article of footwear 100 may be defined by a foot region 148 and an ankle region 150. In general, the foot region 148 is a portion of the upper 102 that extends upwardly from the outsole 104 and through the forefoot region 114, the midfoot region 116, and the heel region 118.

The ankle region 150 is primarily located in the heel region 118; however, in some embodiments, the ankle region 150 may partially extend into the midfoot region 116.

Still referring to FIGS. 1-3, the article of footwear 100 also defines a lateral side 120 and a medial side 122, the lateral side 120 being shown in FIG. 1 and the medial side 122 being shown in FIG. 2. When a user is wearing the article of footwear 100, the lateral side 120 corresponds with an outside-facing portion of the article of footwear 100 while the medial side 122 corresponds with an inside-facing portion of the article of footwear 100. As such, a left sock and a right sock would have opposing lateral sides 120 and medial sides 122, such that the medial sides 122 are closest to one another when a user is wearing the socks, while the lateral sides 120 are defined as the sides that are farthest from one another while the socks are being worn. As will be discussed in greater detail below, the medial side 122 and the lateral side 120 adjoin one another at opposing, distal ends of the article of footwear 100.

Many conventional footwear uppers are formed from multiple elements, e.g., textiles, polymer foam, polymer sheets, leather, synthetic leather, etc., which are joined through bonding or stitching at a seam. In some embodiments, the upper 102 of the article of footwear 100 is formed from a knitted structure or knitted components. In various embodiments, a knitted component may incorporate various types of yarn that may provide different properties to an upper. For example, one area of the upper 102 may be formed from a first type of yarn that imparts a first set of properties, and another area of the upper 102 may be formed from a second type of yarn that imparts a second set of properties. Using this configuration, properties of the upper 102 may vary throughout the upper 102 by selecting specific yarns for different areas of the upper 102.

Referring to FIG. 1, the article of footwear 100 includes a first region 124, e.g., in the forefoot region 114, and a second region 126, e.g., in the adjacent midfoot region 116. The first region 124 may employ a denser knit than the second region 126. Consequently, the second region 126 may allow for more airflow therethrough than the first region 124 (i.e., enhanced breathability). Additionally or alternatively, the first region 124 may have a first stretch resistance, and the second region 126 may have a second stretch resistance that is different than the first stretch resistance. Further, the upper may include a third region 128, e.g., in the heel region 118, that has a third stretch resistance that is different than the first stretch resistance and the second stretch resistance. The first region 124, the second region 126, and the third region 128 may be integrally formed within a tubular knitted component, which may result in the upper 102 being substantially seamless. In some instances, an elasticity (i.e., stretch resistance) of a knit structure may be measured based on comparing a width or length of the knit structure in a first, non-stretched state to a width or length of the knit structure in a second, stretched state after the knit structure has a force applied to the knit structure in a lateral direction.

Furthermore, the properties associated with the upper 102, e.g., a knit type, a yarn type, or characteristics associated with different knit types or yarn types, such as elasticity, aesthetic appearance, thickness, air permeability, or scuff-resistance, may be varied. With reference to the material(s) that comprise the upper 102, the specific properties that a particular type of yarn will impart to an area of the upper may at least partially depend upon the materials that form the various filaments and fibers of the yarn. For example, cotton may provide a soft effect, biodegradability, or a natural aesthetic to a material. Elastane and stretch polyester may each provide a component with a desired elasticity and recovery. Rayon may provide a high luster and moisture absorbent material, wool may provide a material with an increased moisture absorbance, nylon may be a durable material that is abrasion-resistant, and polyester may provide a hydrophobic, durable material.

Other aspects of a fabric component may also be varied to affect the properties of the component and provide desired attributes. For example, a yarn forming a component may include monofilament yarn or multifilament yarn, or the yarn may include filaments that are each formed of two or more different materials. In addition, a fabric component may be formed using a particular process to impart an area of a component with particular properties. Accordingly, both the materials forming the yarn and other aspects of the yarn may be selected to impart a variety of properties to particular areas of the upper 102.

In further aspects, the upper 102 may also include additional structural elements. For example, a heel plate or cover (not shown) may be provided on the heel region 118 to provide added support to a heel of a user. Other elements, e.g., protective plastic material, logos, images, lettering, etc., may also be applied and fixed to an exterior surface using glue or a thermoforming process. Further, in some embodiments, padding or cushioning may be provided in one or more cushioning regions 130 to provide added padding to areas of a foot. For example, as shown in FIG. 1, the cushioning region 130 may be positioned along the lateral side 120 to provide padding for when a user crosses his/her legs. Additionally or alternatively, as shown in FIG. 2, the cushioning region 130 may be disposed along the medial side 122. The cushioning region 130 may include a denser fabric therein. Additionally or alternatively, the cushioning region 130 may comprise added material, such as cotton or foam coupled to the upper, e.g., using an adhesive and/or stitching. Further, the cushioning region 130 may incorporate a thicker yarn, which may result in a softer, more compressive, section of material. More specifically, a yarn used in the cushion region 130 may have a different gauge than a yarn used in the rest of the upper 102.

In some instances, the outsole 104 of the article of footwear 100 may be formed from a thermoplastic polyurethane material. Additionally or alternatively, the outsole 104 may utilize various types of foam, such as high density polyurethane, latex rubber foam, gel foam, and/or polyurethane foam. Further, the outsole 104 may additionally or alternatively incorporate rubber materials in one or more regions. For example, silicone rubber may be used in a portion of the outsole 104 that supports the heel region.

Figure 4:
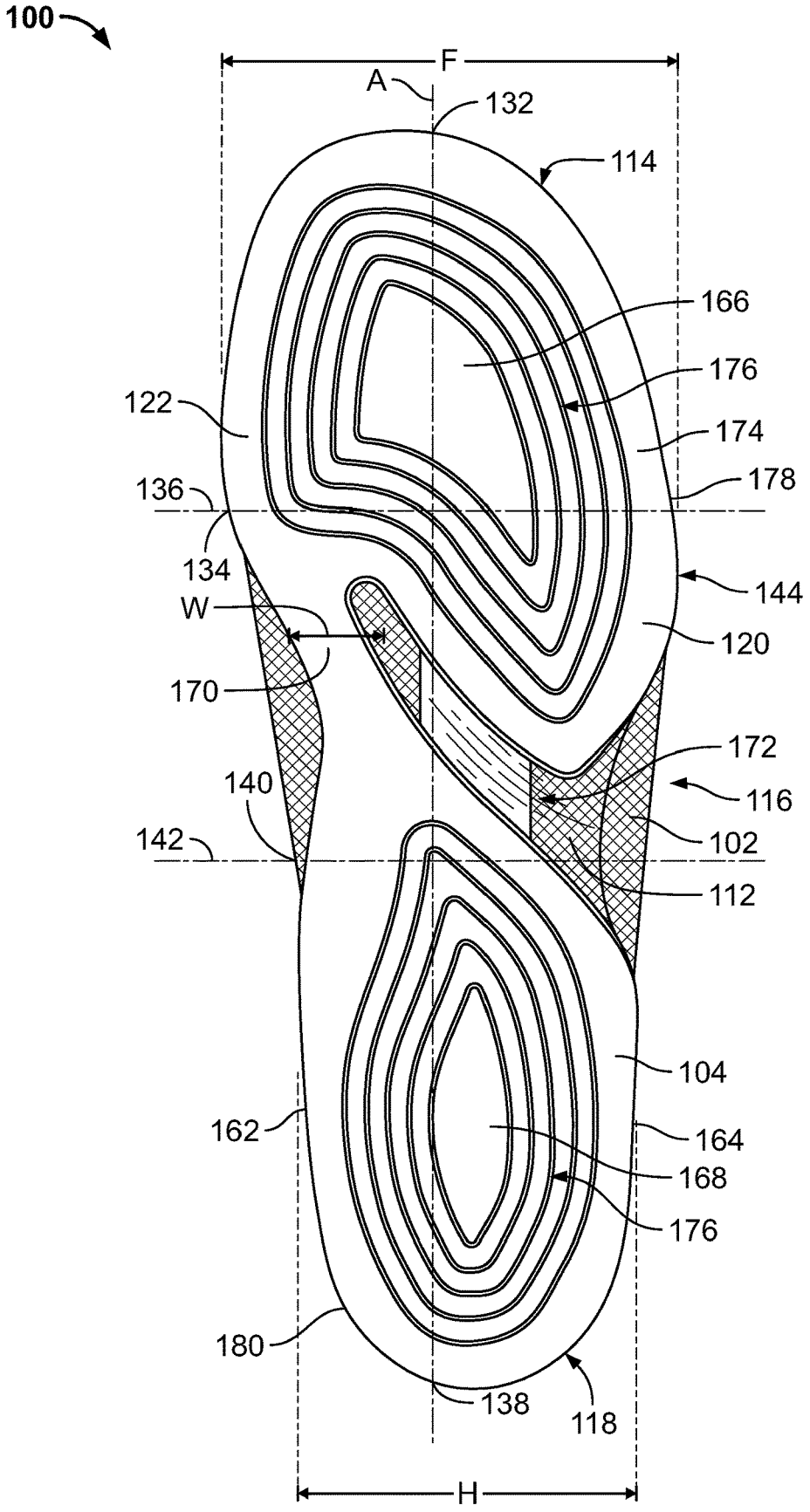
FIG. 4 is a bottom plan view of the article of footwear of FIG. 1.

Turning to FIGS. 3 and 4, the forefoot region 114, the midfoot region 116, the heel region 118, the medial side 122, and the lateral side 120 are intended to define boundaries or areas of the article of footwear 100. To that end, the forefoot region 114, the midfoot region 116, the heel region 118, the lateral side 120, and the medial side 122 generally characterize sections of the article of footwear 100. Certain aspects of the disclosure may refer to portions or elements that are coextensive with one or more of the forefoot region 114, the midfoot region 116, the heel region 118, the lateral side 120, and/or the medial side 122. Further, each of the upper 102, the outsole 104, and skin layer 112 (see FIG. 4) may be characterized as having portions within the forefoot region 114, the midfoot region 116, the heel region 118, and/or along the medial side 122 and/or the lateral side 120.

The forefoot region 114 extends from a toe end 132 to a widest portion 134 of the article of footwear 100, generally aligned with a ball of a wearer's foot. The widest portion 134 is defined or measured along a first line 136 that is perpendicular with respect to a longitudinal axis A that extends from the toe end 132 to a heel end 138, which is opposite the toe end 132. The midfoot region 116 extends from the widest portion 134 generally to a thinnest portion 140 of the article of footwear 100. The thinnest portion 140 of the article of footwear 100 is defined as the thinnest portion of the article of footwear 100 measured across a second line 142 that is perpendicular with respect to the longitudinal axis A and that defines an arch region of the article of footwear 100 on the medial side 122. The heel region 118 extends generally from the thinnest portion 140 to the heel end 138 of the article of footwear 100.

Still referring to FIGS. 3 and 4, the medial side 122 begins at the distal toe end 132 and bows outward along an inner side of the article of footwear 100 along the forefoot region 114 toward the midfoot region 116. The medial side 122 reaches the first line 136, at which point the medial side 122 bows inward, toward the central, longitudinal axis A. The medial side 122 extends from the first line 136, i.e., the widest portion 134, into the midfoot region 116, toward the second line 142, i.e., the thinnest portion 140. Once reaching the second line 142, the medial side 122 bows outward, away from the longitudinal, central axis A, at which point the medial side 122 extends into the heel region 118, i.e., upon crossing the second line 142. The medial side 122 then bows outward and then inward toward the heel end 138, and terminates at a point where the medial side 122 meets the longitudinal, center axis A.

The lateral side 120 also begins at the distal toe end 132 but also bows outward along an outer side of the article of footwear 100 along the forefoot region 114 toward the midfoot region 116. The lateral side 120 reaches the first line 136, at which point the lateral side 120 bows inward, toward the longitudinal, central axis A. The lateral side 120 extends from the first line 136, i.e., the widest portion 134, toward the second line 142, i.e., the thinnest portion 140, at which point the lateral side 120 enters into the midfoot region 116, i.e., upon crossing the first line 136. Once reaching the second line 142, the lateral side 120 bows outward, away from the longitudinal, central axis A, at which point the lateral side 120 extends into the heel region 118, i.e., upon crossing the second line 142. The lateral side 120 then bows outward and then inward toward the heel end 138, and terminates at a point where the lateral side 120 meets the longitudinal, center axis A.

It should be understood that numerous modifications may be apparent to those skilled in the art in view of the foregoing description, and individual components thereof, may be incorporated into numerous articles of footwear. Accordingly, aspects of the article of footwear 100 and components thereof, may be described with reference to general areas or portions of the article of footwear 100, with an understanding the boundaries of the forefoot region 114, the midfoot region 116, the heel region 118, the medial side 122, and/or the lateral side 120 as described herein may vary between articles of footwear.

Referring back to FIG. 4, the upper 102 may be a tubular component that defines the interior cavity 108 that receives and secures a foot of a user. In some instances, the skin layer 112 may be disposed on a portion of the upper 102. More specifically, the skin layer 112 may attach to a portion of the upper 102 that is intended to sit adjacent a bottom of a user's foot. Furthermore, the outsole 104 may attach to the skin layer 112 opposite the upper 102. More specifically, in some instances, the outsole 104 is disposed in an outsole region 144, which may be defined as a portion of the article of footwear 100 that at least partially contacts an exterior surface, e.g., the ground, when the article of footwear 100 is worn. The skin layer 112 may be a thermoplastic polyurethane ("TPU") skin that may enhance stability and rigidity of the article of footwear 100. Further, because the upper 102 may be a tubular section of material, the skin layer 112 may provide a smooth, firm, undulated, and/or curviplanar surface on the upper 102 for the outsole 104 to attach. In addition to the outsole 104 and the skin layer 112, the article of footwear 100 may also include one or more components, such as a heel, a vamp, and/or an insole 146 (see FIG. 5). For example, a sole structure may be provided that includes an outsole that provides structural integrity to the sole structure, along with providing traction for a user, a midsole that provides a cushioning system, and an insole that provides support for an arch of a user.

Referring to FIGS. 1 and 2, the outsole 104 and skin layer 112 may attach to the upper 102 so that the upper 102 and outsole 104, alone or in combination with the skin layer 112, extend along the lateral side 120 and the medial side 122, and across the forefoot region 114, the midfoot region 116, and the heel region 118 to house and enclose a foot of a user. When fully assembled, the upper 102 also includes an interior surface 152 (see FIG. 3) and the exterior surface 110. The interior surface 152 faces inward and generally defines the interior cavity 108, and the exterior surface 110 of the upper 102 faces outward and generally defines an outer perimeter or boundary of the upper 102. The upper 102 also includes an opening 156 that is at least partially located in the heel region 118 of the article of footwear 100, that provides access to the interior cavity 108 and through which a foot may be inserted and removed. In some embodiments, the upper 102 may also include an instep area 158 that extends from the opening 156 in the heel region 118 over an area corresponding to an instep of a foot to an area adjacent the forefoot region 114. The instep area 158 may comprise an area similar to where the second region 126 of the present embodiment is disposed. Further, the instep area 158 may be formed of a unitary, tubular knit fabric, similar to a conventional sock. Therefore, the upper 102 may be configured to stretch as the article of footwear 100 slips onto a foot. That is, the instep area 158, which may comprise a knit with high elasticity, may stretch as the article of footwear 100 is slipped onto the foot. Therefore, the article of footwear 100 may be slipped onto the foot like a sock. After the article of footwear 100 is secured onto the foot, the upper 102 may hug the foot. More specifically, the upper 102 may conform to the foot like a sock. Additionally or alternatively, the instep area 158 may include extra features, such as a tongue, laces, eyelets, zippers, hook and loop fasteners, etc.

Figure 5:
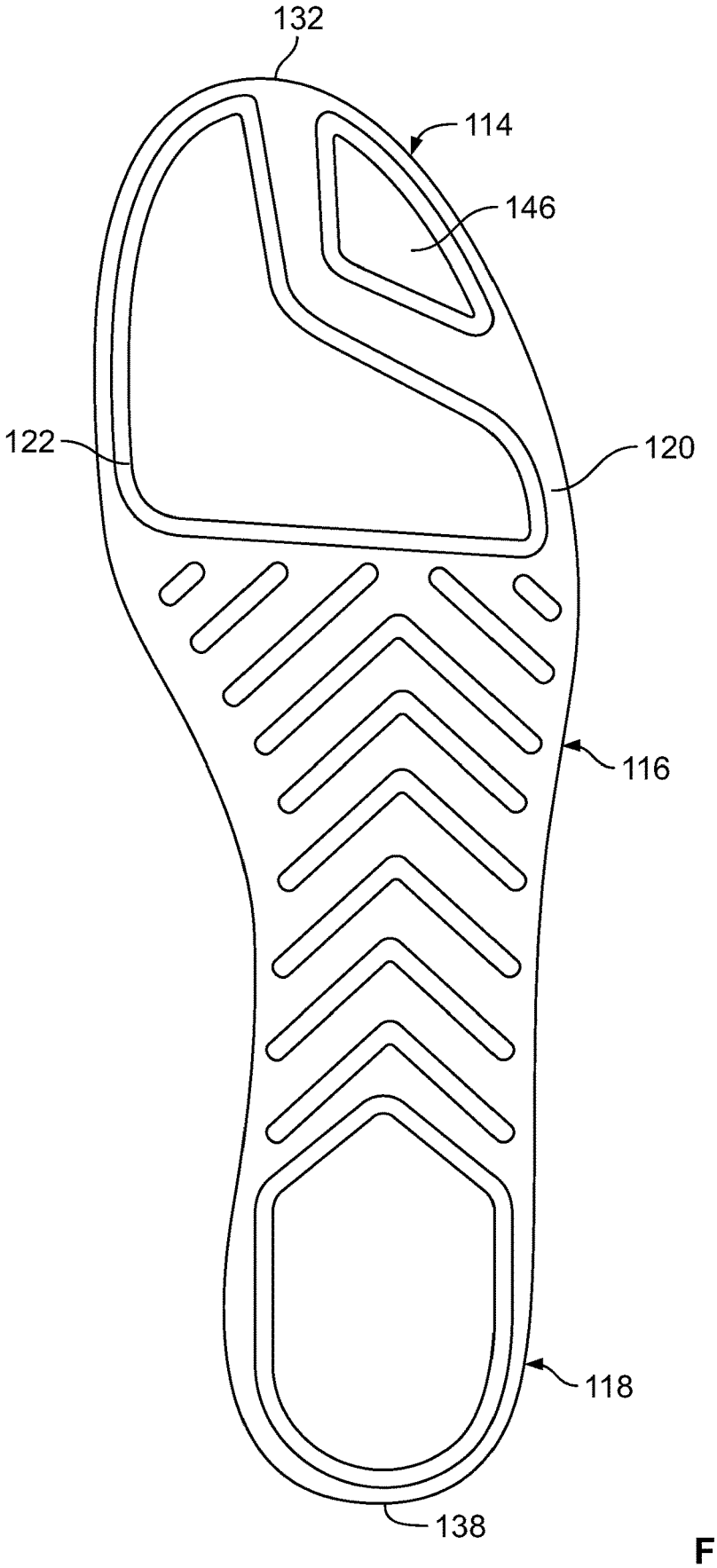
FIG. 5 is a top plan view of an insole usable with the article of footwear of FIG. 1.

Referring to FIG. 5, the article of footwear 100 may further include the insole 146 intended to be disposed within the interior cavity 108 adjacent an insole region 160 (see FIG. 3). The insole 146 may have a shape that is substantially similar to the shape of the article of footwear 100, when viewed from above or below (see FIGS. 3 and 4). In some embodiments, the insole 146 may have a uniform stiffness. More specifically, each of a portion of the insole 146 disposed in the forefoot region 114, a portion of the insole 146 disposed in the midfoot region 116, and a portion of the insole 146 disposed in the heel region 118 may have substantially equivalent stiffness and densities. However, in some aspects, the insole 146 may have at least two regions of differing stiffness. For example, the portion of the insole 146 disposed in the midfoot region 116 and the portion of the insole 146 disposed in the heel region 118 may be denser and more rigid than the portion of the insole 146 disposed in the forefoot region 114. As a result, the portion of the insole 146 disposed in the midfoot region 116 and the portion of the insole 146 disposed in the heel region 118 may provide enhanced support and stiffness compared to the portion of the insole 146 disposed in the forefoot region 114. Additionally or alternatively, the portion of the insole 146 disposed in the heel region 118 may be stiffer than the portion disposed in the midfoot region 116. Consequently, the portion in the forefoot region 114 and the portion in the midfoot region 116 may provide enhanced flexibility compared to the heel region 118.

Referring back to FIG. 4, the outsole 104 of the article of footwear 100 is shown in detail. The outsole 104 may be characterized by a medial edge 162 disposed along the medial side 122 and a lateral edge 164 disposed along the lateral side 120. In some instances, the outsole 104 may include a forefoot support surface 166, a heel support surface 168, and, optionally, a midfoot bridge 170. In some aspects, the forefoot support surface 166 and the heel support surface 168 may be distinct, discontinuous components of the outsole 104. The forefoot support surface 166 is configured to support the forefoot region 114. Further, the forefoot support surface may extend along the lateral side 120 into the midfoot region 116. The heel support surface 168 is configured to support the heel region 118. Furthermore, the heel support surface 168 may extend beyond the heel region 118 along the medial side 122 of the article of footwear 100 into the midfoot region 116, and connect to the midfoot bridge 170. The midfoot bridge 170 may connect the heel support surface 168 to the forefoot support surface 166 proximate the medial side 122. The midfoot bridge 170 may have a midfoot width W that is significantly narrower than each of a forefoot support surface width F and a heel support surface width H. For example, in some embodiments, the midfoot bridge width W may be less than 50% of the forefoot support surface width F and/or the heel support surface width H. In some embodiments, the midfoot bridge width W may be less than 25% of the forefoot support surface width F and/or the heel support surface width H. As a result, a notch 172 is defined between the forefoot support surface 166 and the heel support surface 168, adjacent the midfoot bridge 170.

Additionally, the outsole 104 may be textured to provide enhanced grip on an outer surface 174 thereof. More specifically, referring to FIG. 4, the forefoot support surface 166 and heel support surface 168 may include a plurality of recessed channels 176. These channels 176 may be shaped substantially similar to an outer edge 178 of the forefoot support surface 166 or an outer edge 180 of the heel support surface 168. Further, these channels 176 may be concentric with the outer edge 178 of the forefoot support surface 166 or the outer edge 180 of the heel support surface 168.

Referring again to FIGS. 1 and 2, the outsole 104 may further include a medial wrap-up 182, a lateral wrap-up 184, and a heel wrap-up 186, the medial wrap-up 182 being shown in FIG. 2 and the lateral wrap-up 184 being shown in FIG. 1. Each of the medial wrap-up 182, the lateral wrap-up 184, and the heel wrap-up 186 may be an area of increased rigidity relative to an average overall rigidity of the upper 102. In one instance, one or more of the medial wrap-up 182, the lateral-wrap up 184, and the heel wrap-up 186 may be integral extensions of the outsole 104 that extend upward from an upper perimeter defined by a remainder of the outsole 104, i.e., by the non-wrap-up portions of the outsole 104. In another instance, one or more of the wrap-ups may be formed separately from the outsole 104 and may be joined to a remainder of the article of footwear 100 in a boundary region between the upper 102 and the outsole 104, e.g., via stitching and/or an adhesive. Further, as will be described further herein, they may provide additional support, stability, and grip to a user of the article of footwear 100. The heel wrap-up 186 may comprise a medial heel portion 188 and a lateral heel portion 190, which may extend from the medial edge 162 and the lateral edge 164 of the outsole 104, respectively, the medial heel portion 188 being shown in FIG. 2 and the lateral heel portion 190 being shown in FIG. 1. Further, a rear heel portion 192 may be disposed between and connect to the medial heel portion 188 and lateral heel portion 190, thereby defining a heel cup 194 configured to receive and retain a heel of a user's foot. Furthermore, referring to FIG. 2, the medial wrap-up 182 may gradually extend away from the forefoot support surface 166 along the medial edge 162 adjacent the midfoot bridge 170, and gradually reduce adjacent the toe end 132 of the article of footwear 100. Referring to FIG. 1, the lateral wrap-up 184 may gradually extend from the forefoot support surface 166 along the lateral edge 164 adjacent the notch 172 until it approaches the toe end 132 of the article of footwear 110. At the toe end 132, the lateral wrap-up may abruptly reduce. Each of the medial wrap-up 182, the lateral wrap-up 184, and the heel wrap-up may extend from the forefoot support surface 166 and heel support surface 168 in a direction generally normal to the forefoot support surface 166 and heel support surface 168.

Figure 7:
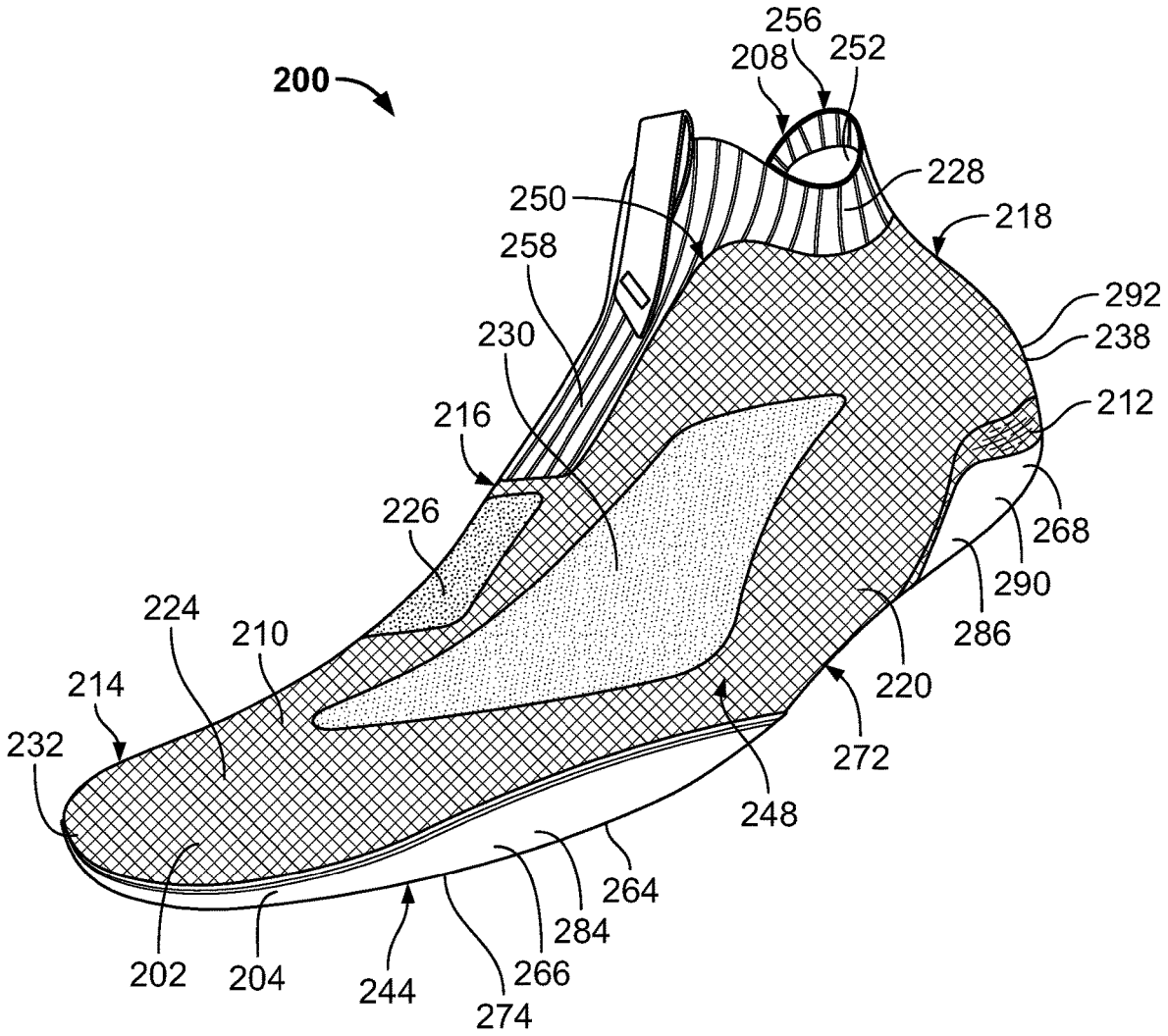
FIG. 7 is a left perspective view of an article of footwear according to a second embodiment.
Figure 8:
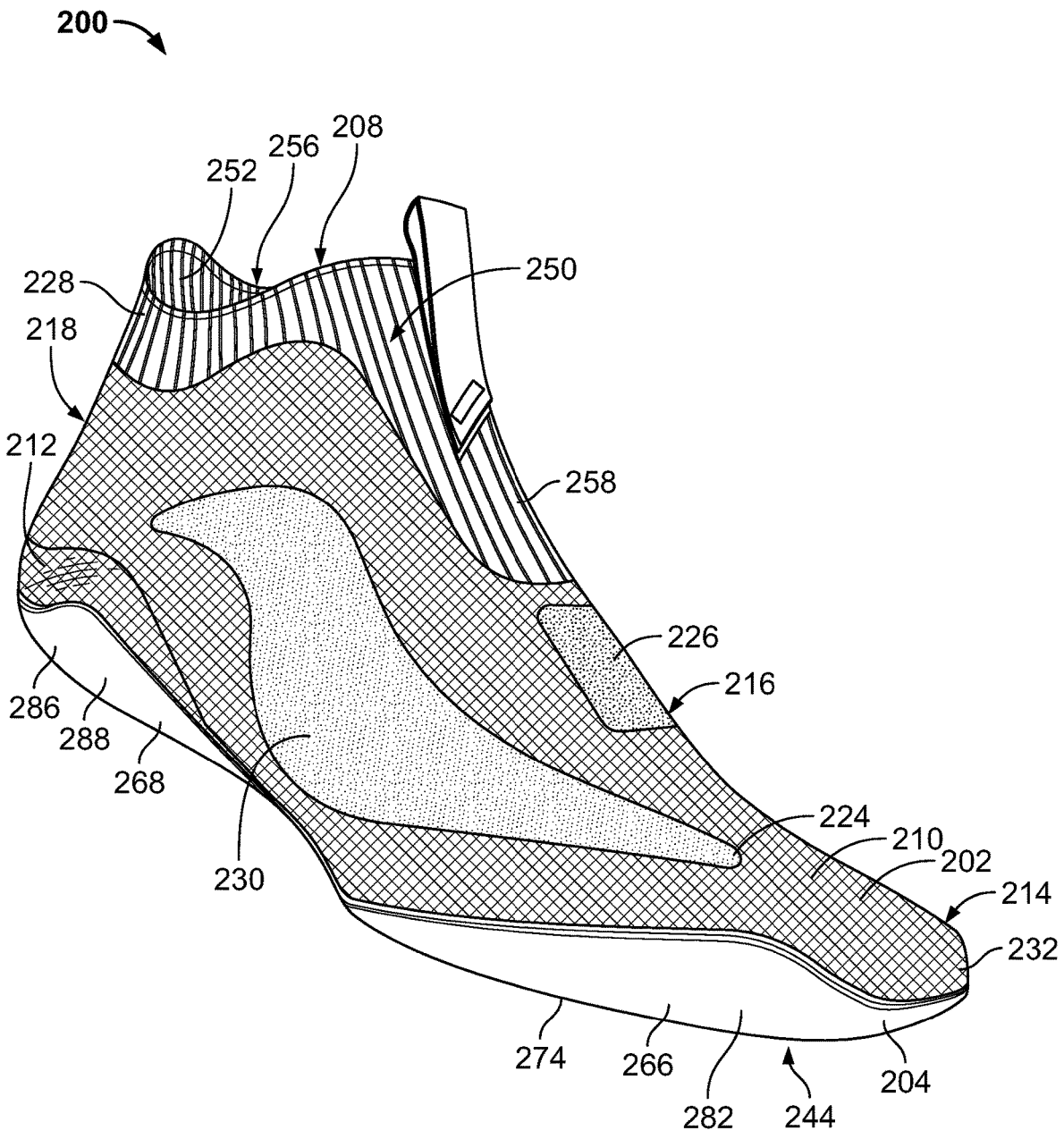
FIG. 8 is a right perspective view of the article of footwear of FIG. 7.
Figure 9:
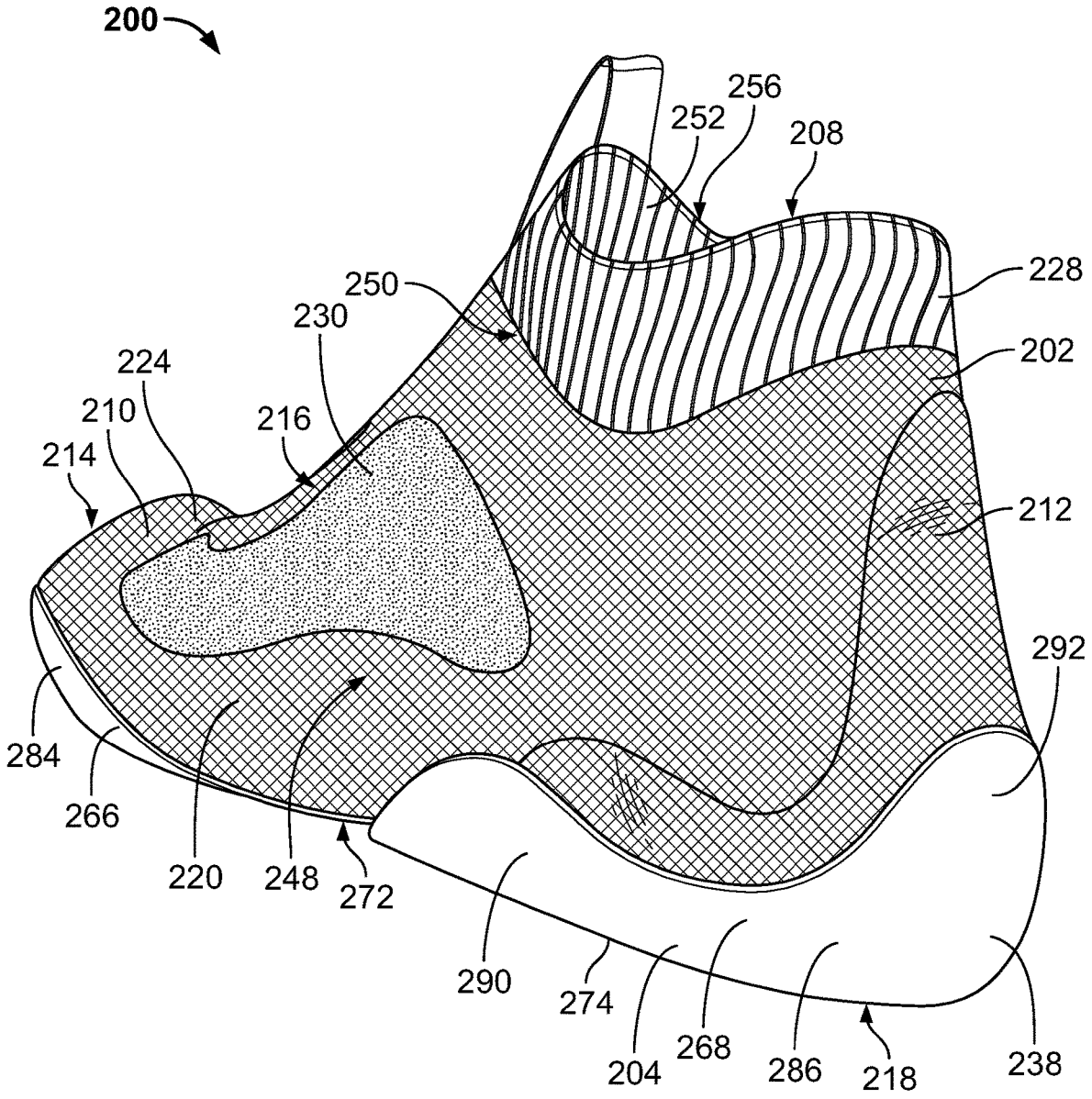
FIG. 9 is another left perspective view of the article of footwear of FIG. 7.

FIGS. 7-9 depict another exemplary embodiment of an article of footwear 200 including an upper 202 and an outsole 204. Aspects of the present embodiment are substantially equivalent to the aforementioned embodiment of FIGS. 1-6. More specifically, referring to FIGS. 7-9, the article of footwear 200 may be characterized by a forefoot region 214, a midfoot region 216, a heel region 218, a lateral side 220, and a medial side 222. Further, the outsole 204 may include a forefoot support surface 266, a heel support surface 268, a medial wrap-up 282, a lateral wrap-up 284, and a heel wrap-up 286 that includes a medial heel portion 288, a lateral heel portion 290, and a rear heel portion 292 (see FIG. 9). The lateral side 220, the lateral wrap-up 284, and the lateral heel portion 290 may be best seen in FIG. 7, whereas the medial side 222, the medial wrap-up 282, and the medial heel portion 288 may be best seen in FIG. 8. One or more of the wrap-ups in this embodiment may be constituted and/or integrated into the article of footwear 200 in a manner similar to those in the aforementioned example, thereby providing additional support, stability, and grip for a user of the article of footwear 200.

Still referring to FIGS. 7-9, features of the outsole 204 identified are provided to deliver support and stability to a user's foot in different positions. For example, if a foot presses flat into a surface (e.g., the ground), a majority of the user's weight may be in the forefoot region 214. In this instance, the lateral wrap-up 184 may provide enhanced support to the foot by providing a rigid surface that abuts a lateral side of the foot, thereby reducing compressive forces transmitted directly to the lateral side of the foot. In another example, a user may sit such that a majority of that user's weight again is disposed in the forefoot region 214, but with the heel region 218 raised off the surface. In this position, the medial wrap-up 282 may provide enhanced support to the foot by providing a rigid surface that abuts a medial side of the foot, thereby reducing compressive forces transmitted directly to the medial side of the foot. In still another example, when the majority of the user's weight is in the heel region 218 or when the user's weight is evenly distributed throughout the outsole 204, the heel wrap-up 286 may provide enhanced stability and support to the foot by providing a rigid surface that holds a heel region of the foot and reduces compressive forces transmitted directly to the heel.

Figure 10:
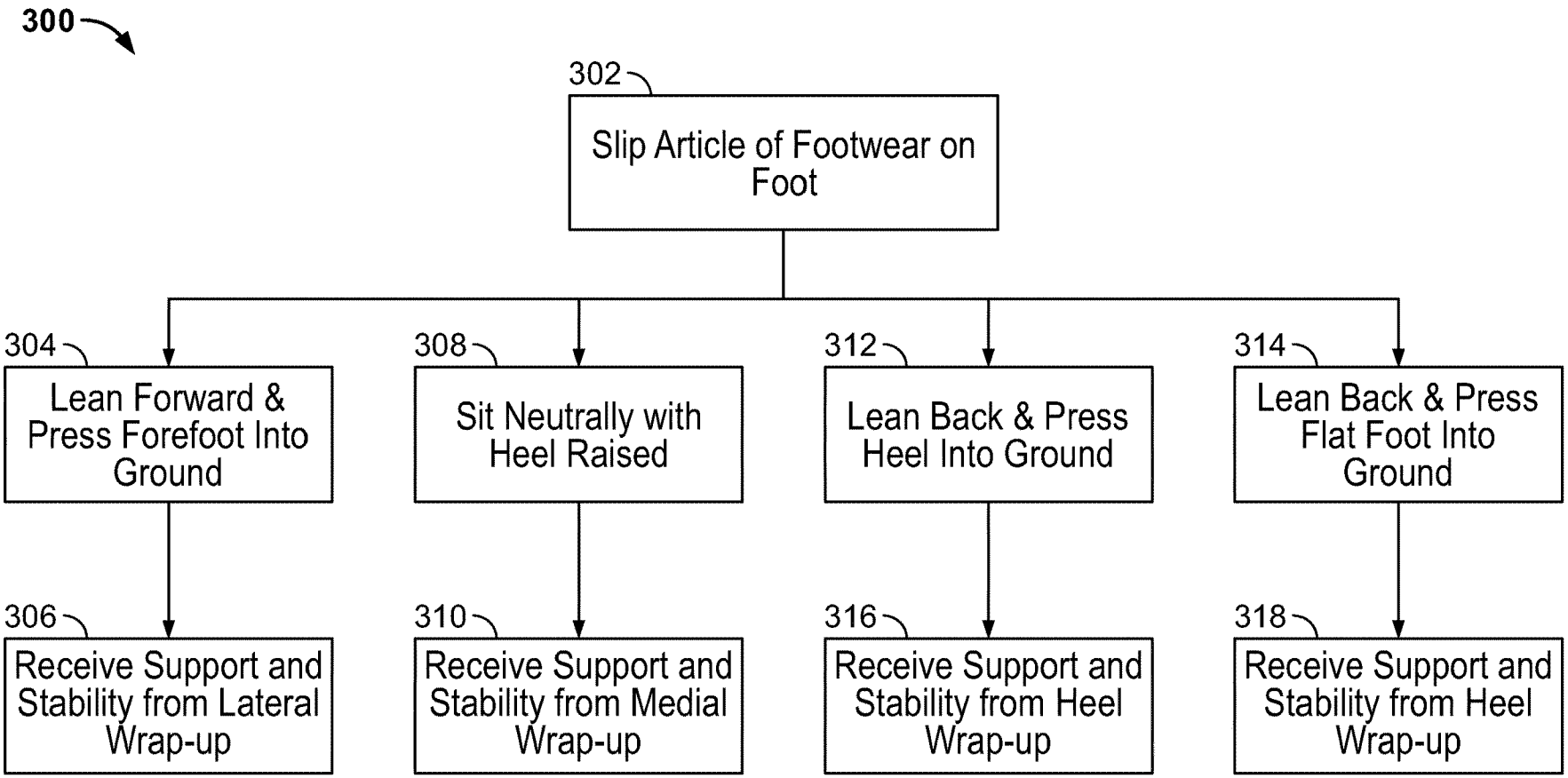
FIG. 10 is a block diagram of a method for using the article of footwear of FIG. 7.

FIG. 10 depicts a method 300 for using the article of footwear according to aspects of the present disclosure. At step 302, a user may slip the article of footwear onto a foot. More specifically, the user may insert the foot into the opening so that the foot is secured within the interior cavity of the article of footwear and surrounded by the upper of the article of footwear. When in a seated position, if the user leans forward and presses the foot flat against the ground (i.e., step 304), the method may proceed to step 306, wherein the foot may receive enhanced support and stability from the lateral wrap-up. Alternatively or additionally, if the user sits neutrally and presses the ball of the foot into the ground and raises the heel (i.e., step 308), the method may proceed to step 310, wherein the foot may receive enhanced support and stability from the medial wrap-up. Further, alternatively or additionally, if the user leans backward and either presses the foot flat against the ground (i.e., step 312) or rests the foot flat on the ground (i.e., step 314), the method may proceed to step 316 or step 318, respectively, wherein the foot may receive enhanced stability or support from the heel wrap-up.

Still referring to FIG. 10, as the user slips the article of footwear onto the foot at step 302, the upper around the opening may stretch over the foot. That is, the instep and areas of the upper surrounding the opening, which may comprise a knit with high elasticity, may stretch as the article of footwear is slipped onto the foot. Therefore, the article of footwear may be slipped onto the foot like a sock. After the article of footwear is secured onto the foot, the upper may hug the foot. More specifically, the upper may conform to the foot like a sock.

Figure 11:
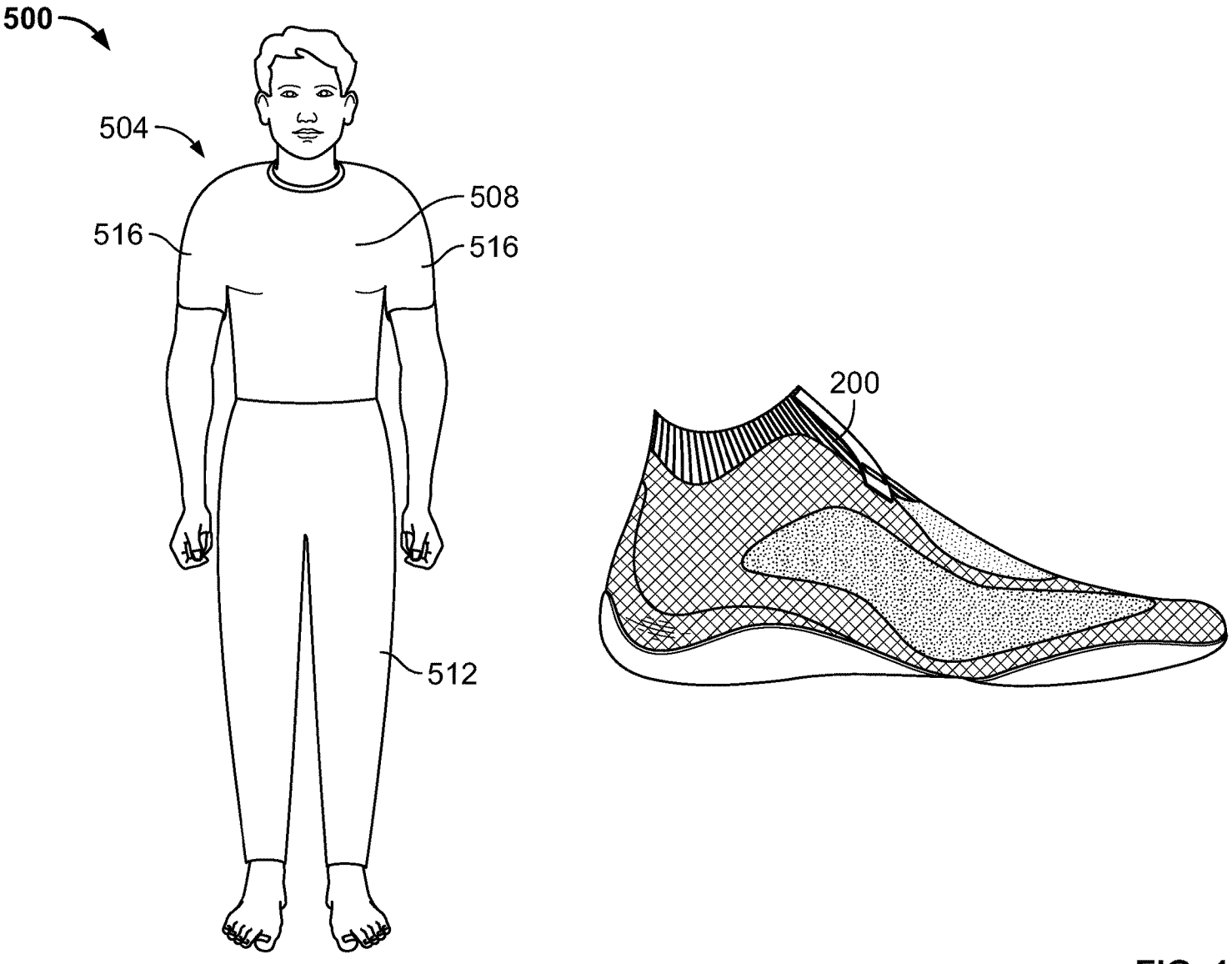
FIG. 11 is a perspective view of a gaming outfit assembly that includes a gaming suit and the article of footwear of FIG. 7.

Referring to FIG. 11, another aspect of the present disclosure may be to provide the article of footwear 200 as a component of a gaming outfit assembly 500. FIG. 11 illustrates the gaming outfit assembly 500 that comprises the article of footwear 200 and a gaming suit 504. Although FIG. 11 only depicts the article of footwear 200 as a right sock, it is to be understood that the gaming outfit assembly 500 may also include a corresponding left sock. As previously mentioned, the left sock and the right sock may be similar in all material aspects, except that the left sock and the right sock are sized and shaped to receive a left foot and a right foot of a user, respectively. For ease of disclosure, a single sock will be referenced to describe the article of footwear 200 according to aspects of the present disclosure. Further, although the gaming outfit assembly 500 is intended to be worn during videogame activities, it may be used during a variety of sedentary activities, such as typing, piano playing, painting, etc. The gaming suit 504 may comprise two apparel components: a top 508 and a bottom 512. The top 508 may be a short sleeve shirt, a long sleeve shirt, jacket, or sweatshirt. Further, the top 508 may incorporate added features to provide enhanced comfort during gaming activities. For example, if sleeves 516 on the top 508 are long sleeve, they may incorporate additional space in elbow regions (not shown). More specifically, the elbow regions on the sleeves 516 may be roomier than conventional long sleeve shirts and jackets, which may result in enhanced comfort during gaming activities. The gaming suit 504 and article of footwear 200 may share similar aesthetic styles. For example, the gaming suit 504 and the article of footwear 200 may be similar colors, use similar materials, have similar textures, etc.

Figure 12:
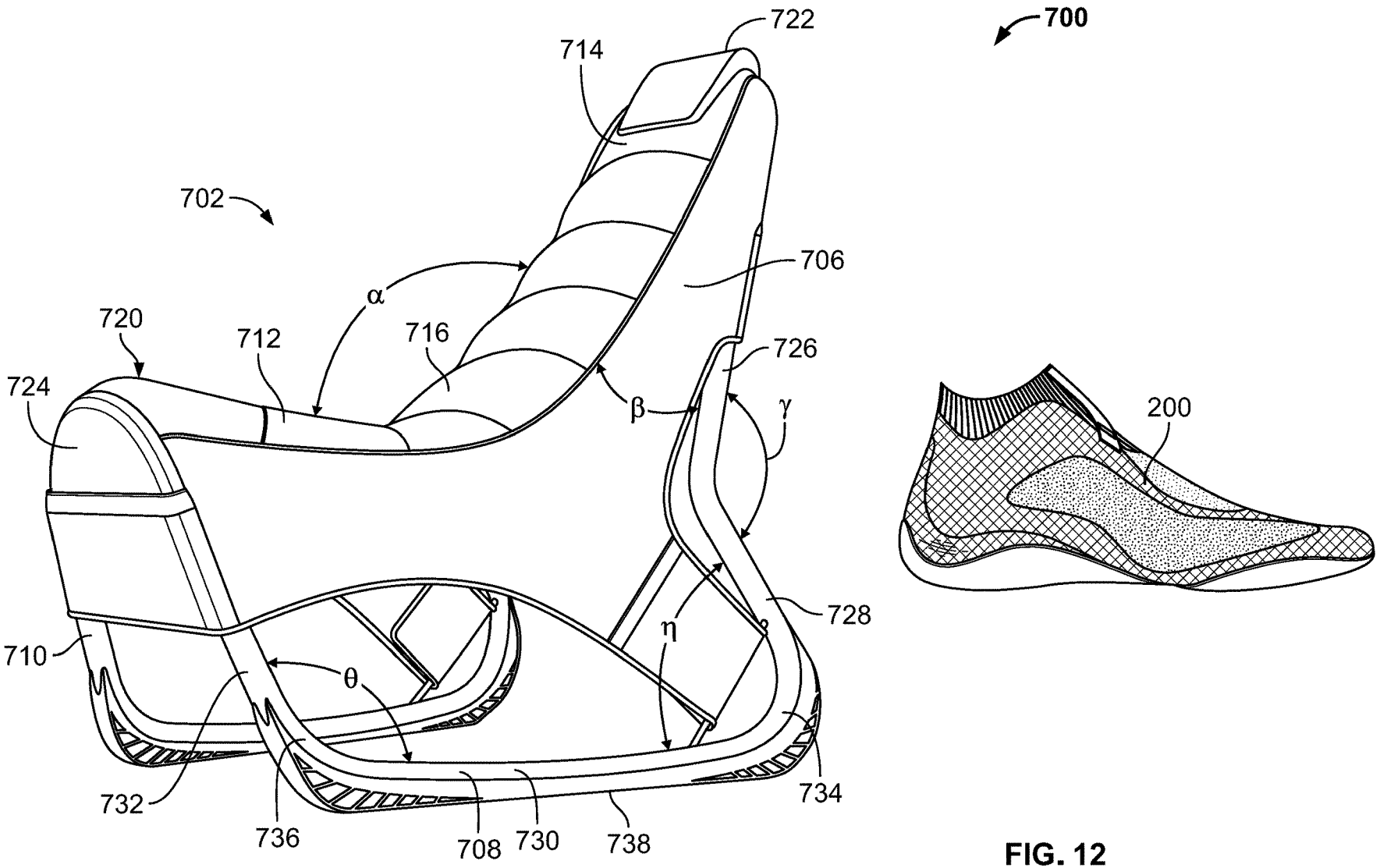
FIG. 12 is a perspective view of a footwear assembly that includes a gaming chair and the article of footwear of FIG. 7.

Referring to FIGS. 12-16, additionally or alternatively, another general aspect of the present disclosure may be to provide the article of footwear 200 as a component in a footwear assembly 700. For example, the footwear assembly 700 may include the article of footwear 200 and a chair. It should be understood that the footwear assembly 700 may include the article of footwear 200, its counterpart, and the chair. More specifically, the footwear assembly may include a left sock, a right sock, and the chair. The article of footwear 200 may be designed to be worn by a user sitting in the chair; further, the article of footwear 200 may provide benefits to the user when he/she sits in different sitting positions. FIGS. 12-16 provide a non-limiting example of the footwear assembly 700 according to aspects of the present disclosure. For example, FIG. 12 depicts the gaming footwear assembly 700, which includes the article of footwear 200 and a gaming chair 702. Again, although FIG. 12 only depicts the article of footwear 200 as a right sock, it is to be understood that the gaming footwear assembly 700 may also include a corresponding left sock. The article of footwear 200 may be intended to be worn by a user 704 (see FIGS. 13-16) sitting in the gaming chair 702 while playing videogames. Although the chair 702 is intended to be used during videogame activities, the article of footwear 200 may be combined with chairs intended for a variety of activities, such as sleeping, reading, knitting, sewing, painting, piano playing, typing, etc.

Referring to FIG. 12, the gaming chair 702 may include a seat 706, and a first leg 708 and second leg 710 extending therefrom. The seat section may include a bottom section 712 and a back section 714. The back section 714 may be oriented from the bottom section 712 at an angle $\alpha$. In some embodiments, the angle $\alpha$ may be greater than 90°. Further, in some embodiments, the angle $\alpha$ may be greater than 100°. The seat 706 may further include a curved base section 716, which is provided to connect the back section 714 and the bottom section 712. Further, the curved base section 716 may create a continuous surface extending across the back section 714, the curved base section 716, and the bottom section 712. For reference, the seat 706 may be characterized by a left side 718, right side 720, top end 722, and bottom end 724. The first leg 708 and the second leg 710 may be tubular structures that extend from the seat 706. Additionally, the first leg 708 and second leg 710 may be similar in all material aspects, except that the first leg 708 and second leg 710 are mirror images of each other. For ease of disclosure, the first leg 708 will be referenced to describe aspects of the disclosure. However, it is to be understood that the first leg 708 and second leg 710 share material aspects and are mirror images of each other.

Still referring to FIG. 12, the first leg 708 may comprise a first portion 726, a second portion 728, a third portion 730, and a fourth portion 732. The first portion 726 may extend from the left side of the chair 704 proximate the top end 722 at an angle $\beta$ from the back section 714. In some embodiments, the angle $\beta$ may be less than 45°. Further, in some embodiments, the angle $\beta$ may be less than 30°. Attached to the first portion 726 may be the second portion 728. The second portion 728 may be at an angle $\gamma$ from the first portion 726. In some embodiments, the angle $\gamma$ may be greater than 60°. Further, in some embodiments, the angle $\gamma$ may be greater than 90°. The third portion 730 may be connected to the second portion 728 by way of a first curved portion 734. The first curved portion 734 may be provided to create a smooth transition from the third portion 730 to the second portion 728. Further, the third portion 730 may be at an angle $\eta$ from the second portion 728. In some embodiments, the angle η may be less than 90°. The fourth portion 732 may extend from the third portion 730 at an angle θ. Further, a second curved portion 736 may be disposed between the third portion 730 and fourth portion 732 to create a smooth transition. In some embodiments, the angle θ may be greater than 90°. Each of the first portion 726, the second portion 728, the third portion 730, the fourth portion 732, the first curved portion 734, and the second curved portion 736 may be connected to form a united, smooth, curved leg. Additionally, a bumper 738 may be attached to the first leg 708 along the third portion 730, the first curved portion 734, and the second curved portion 736 to provide a barrier between the first leg 708 and a surface (i.e., the ground).

Figure 13:
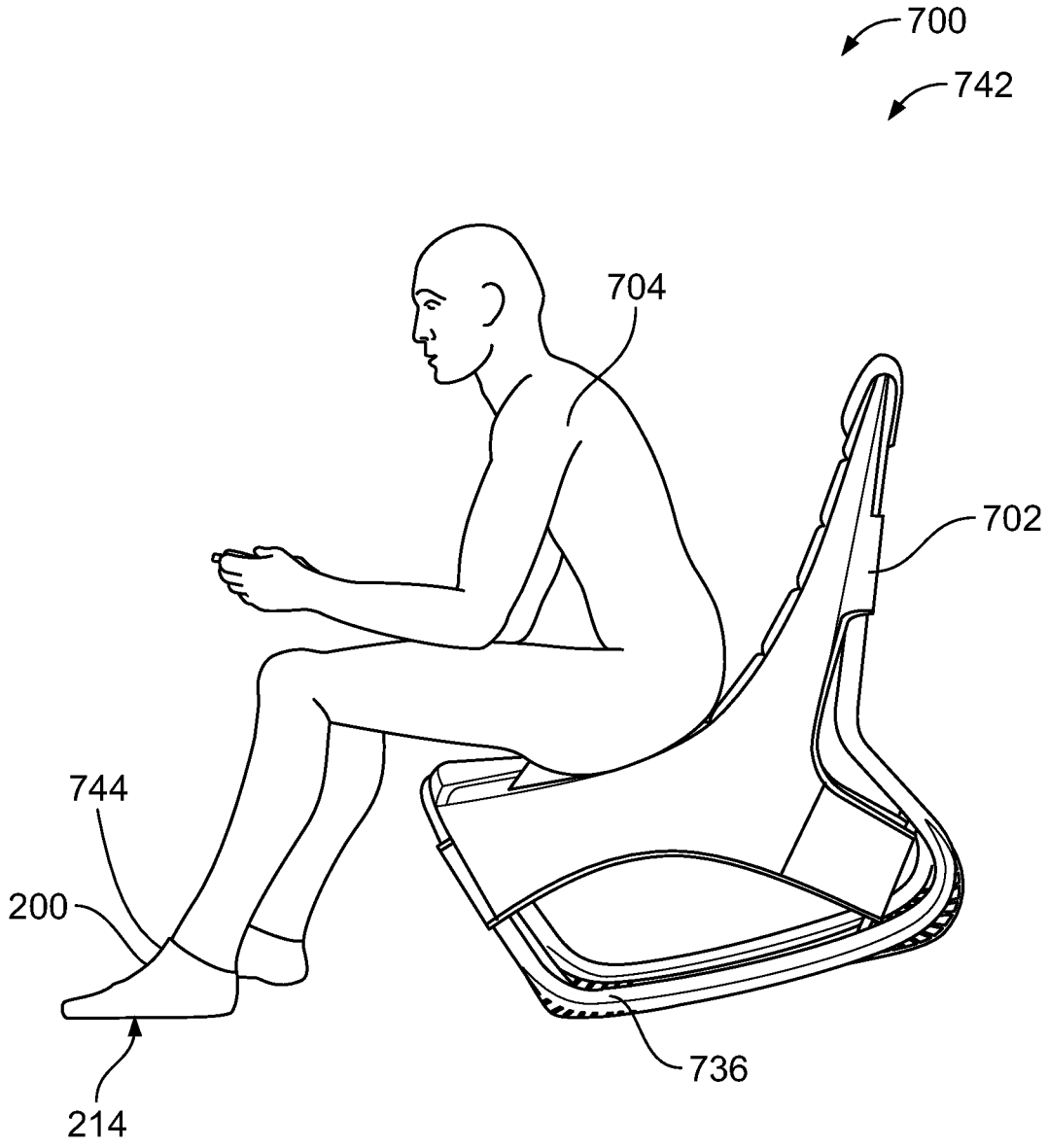
FIG. 13 is a side view of the gaming chair of FIG. 12 in use.
Figure 14:
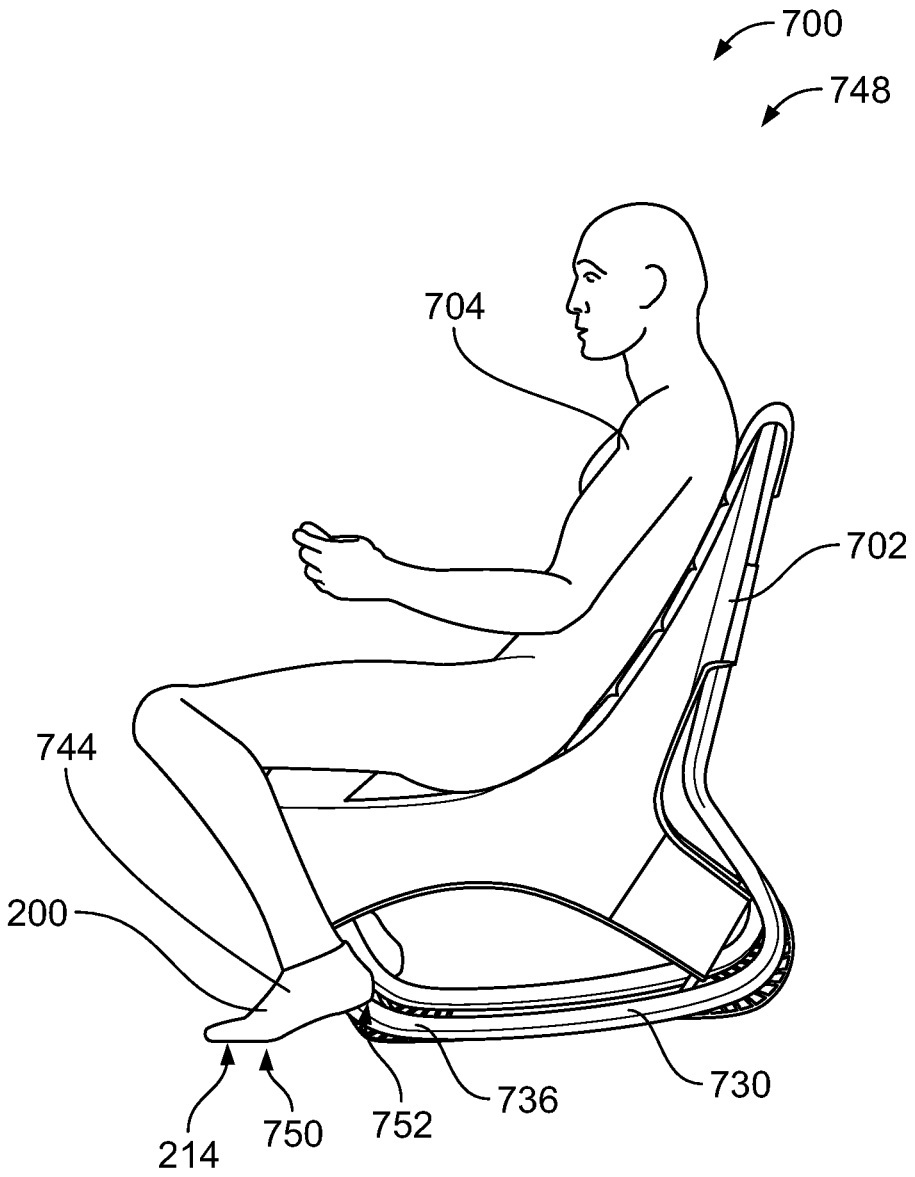
FIG. 14 is a side view of the gaming chair of FIG. 12 in use in an alternate state.

With reference to FIGS. 13-16, the article of footwear 200 may provide benefits to the user 704 when the user 704 sits in different position on a chair, including but not limited to the gaming chair 702. Referring to FIG. 13, there are times when individuals assume a more aggressive stance, i.e., an "attack mode" 742. In such a situation, the user 704 may lean forward in the gaming chair 702 and position a foot 744 flat against and pressed into a ground surface. By leaning forward, the gaming chair 702 may tilt so that the gaming chair 702 is primarily supported by the second curved portion 736. As a result of the user's posture, alone or in combination with a modified chair orientation, the majority of the user's weight may be in the forefoot region 214. Thus, in attack mode 742, the lateral wrap-up 284 (see FIG. 7) may provide enhanced support to the foot 744.

In other situations, individuals may assume a more relaxed, but still heightened, stance to reflect gaming situations where increased, but less than peak, attention is required. In such situations, i.e., in a "focus mode" 748, the user 704 may sit neutrally in the chair 702 and have a ball 750 of the foot 744 planted on the ground surface and a heel 752 of the foot 744 raised, such as in FIG. 14. More specifically, the gaming chair 702 may be primarily supported by the third portion 730 and the second curved portion 736. As a result of this posture, alone or in combination with the chair orientation, the majority of the user's weight may be in the forefoot region 214. In this position, the medial wrap-up 282 (see FIG. 8) may provide support to the foot 744.

Figure 15:
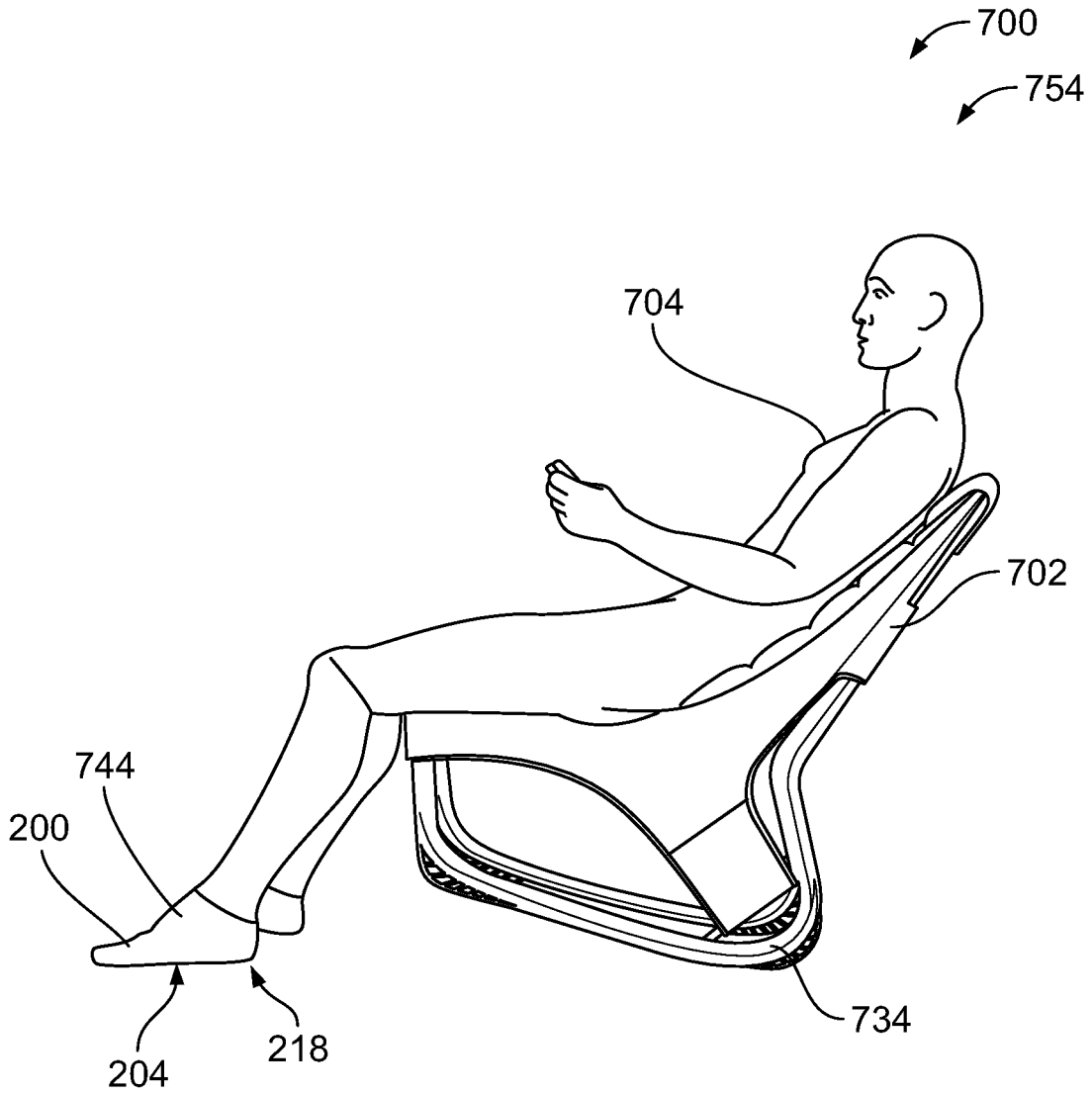
FIG. 15 is a side view of the gaming chair of FIG. 12 in use in an alternate state.

In still other situations, i.e., a "defense mode" 754, the user 704 may have the foot 744 flat against and pressed into the ground surface, as seen in FIG. 15. More specifically, the gaming chair 702 may tilt so that it is primarily supported by the first curved portion 734. Consequently, as a result of this posture, alone or in combination with the chair orientation, the majority of the user's weight may be in the heel region 118.

Figure 16:
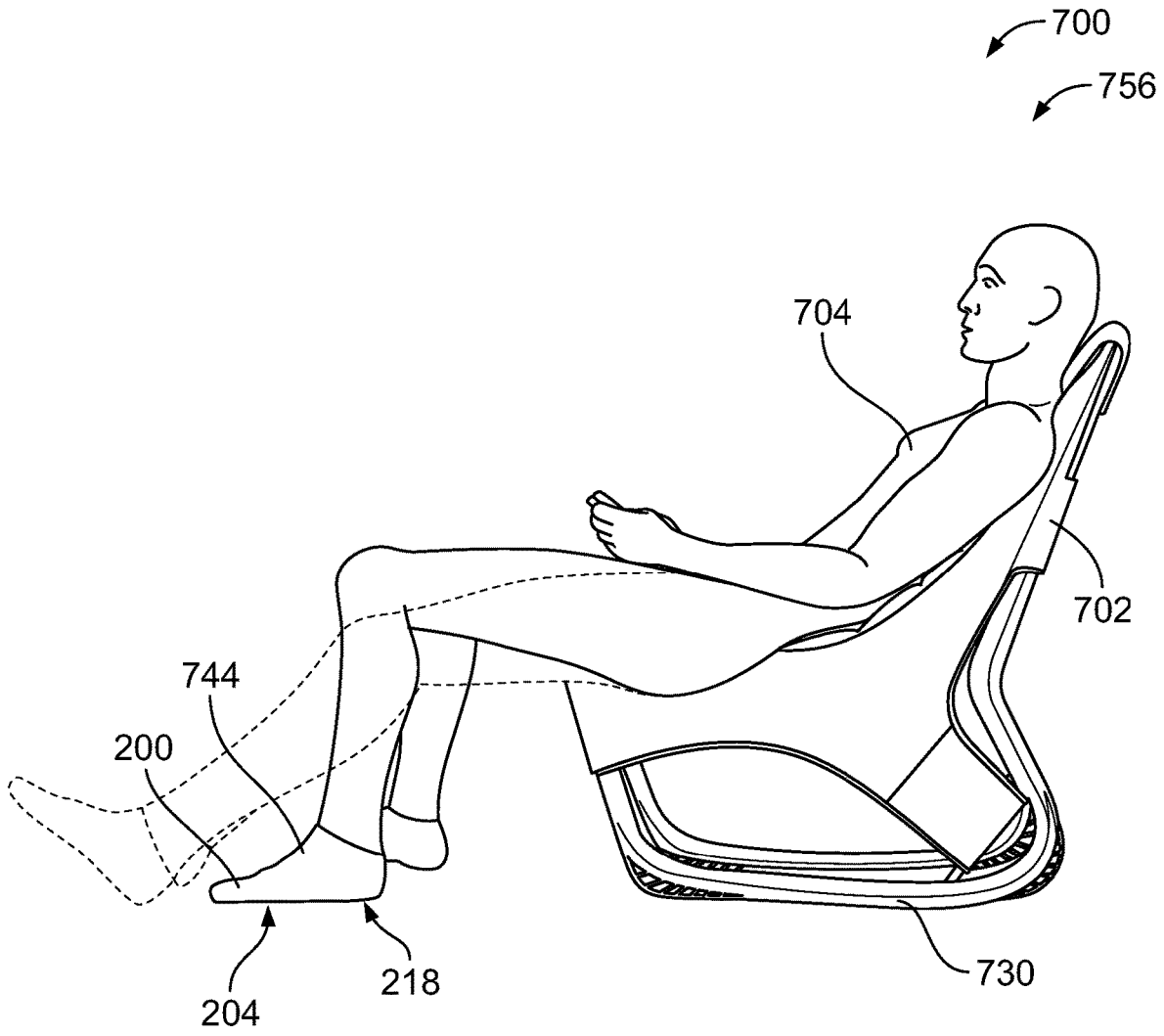
FIG. 16 is a side view of the gaming chair of FIG. 12 in use in an alternate state.
Figure 17:
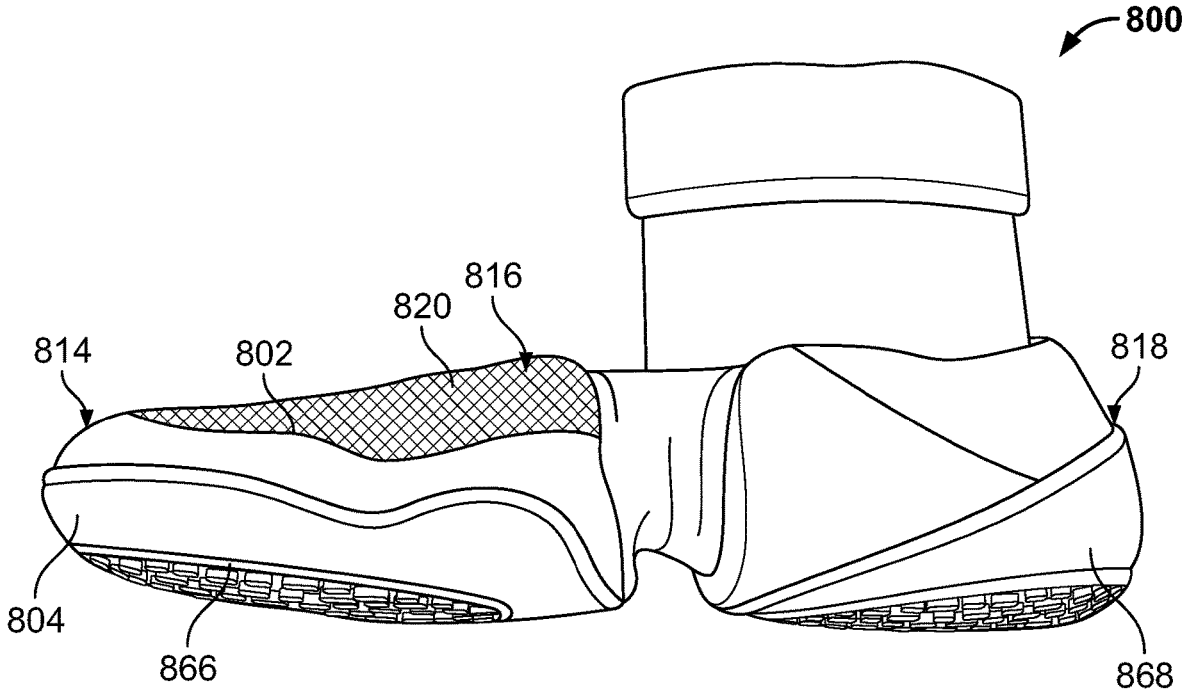
FIG. 17 is a left perspective view of an article of footwear according to a third embodiment.
Figure 18:
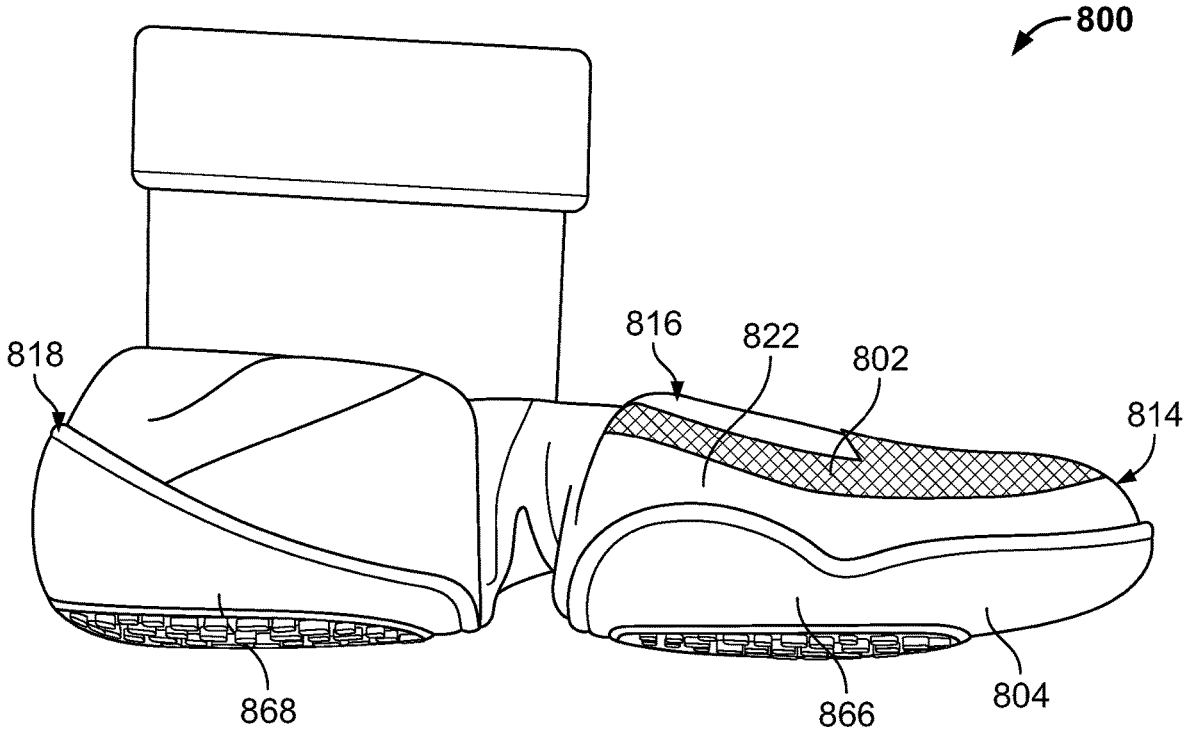
FIG. 18 is a right perspective view of the article of footwear of FIG. 17.
Figure 19:
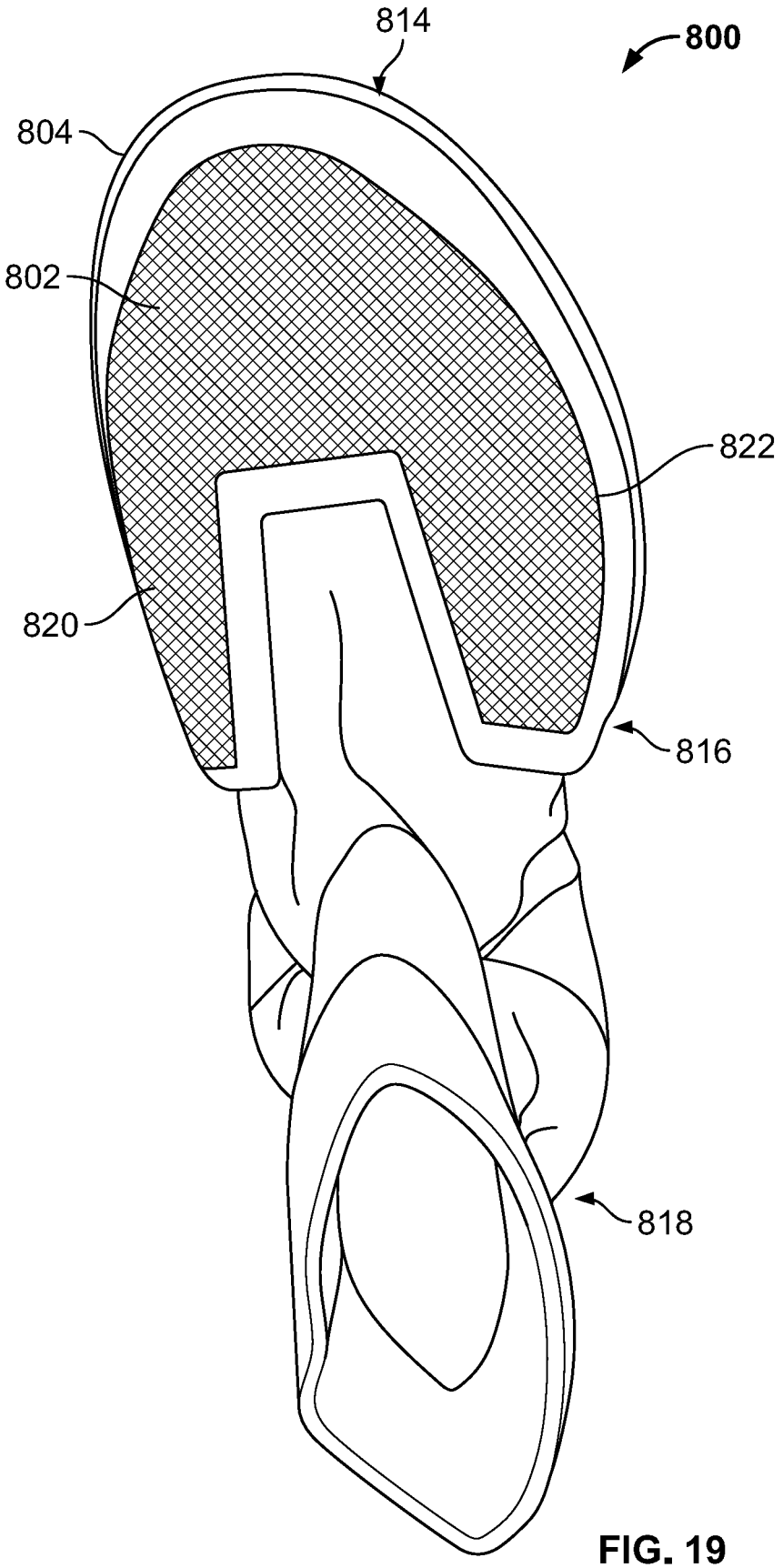
FIG. 19 is a top perspective view of the article of footwear of FIG. 17.

Still further, in other situations, individuals may assume a highly relaxed position, i.e., a "relax mode" 756, in which the gaming chair may be supported by the third portion 730, and the user 704 may position the foot 744 flat on the ground surface or with the heel on the ground and the midfoot and/or forefoot regions elevated, as seen in FIG. 16. As a result of the former posture, alone or in combination with the chair orientation, the user's weight may be evenly distributed throughout the outsole 204. As a result of the latter posture, alone or in combination with the chair orientation, the user's weight may be concentrated on the heel portions of the outsole. In both defense mode 754 and relax mode 756, the heel wrap-up 286 (see FIG. 9) may provide enhanced stability and support.

FIGS. 17-20 illustrate an additional embodiment of an article of footwear 800 intended for indoor activities according to aspects of the present disclosure. The article of footwear 800 according to the present embodiment is substantially similar to the article of footwear 100 depicted in FIGS. 1-6 and the article of footwear 200 depicted in FIGS. 7-9; however, the article of footwear 800 includes an upper 802 and an outsole 804 that include a forefoot support surface 866 and a separate, discontinuous heel support surface 868. That is, the outsole 804 may include two distinct components. By providing the forefoot support surface 866 and heel support surface 868 as separate components, the article of footwear 800 may provide enhanced flexibility, stretch, and comfort as compared to a unitary construction such as the one shown in FIG. 1-6 or 7-9. Additionally, similar to the article of footwear 100 depicted in FIGS. 1-6 and the article of footwear 200 depicted in FIGS. 7-9, the article of footwear 800 according to the present aspect may be characterized by a forefoot region 814, a midfoot region 816, a heel region 818, a lateral side 820 (see FIG. 17), and a medial side 822 (see FIG. 18). It is to be understood that definitions of these regions are substantially equivalent to regions of the aforementioned article of footwear 200 in FIGS. 1-4 and the article of footwear 200 depicted in FIGS. 7-9.

Figure 20:
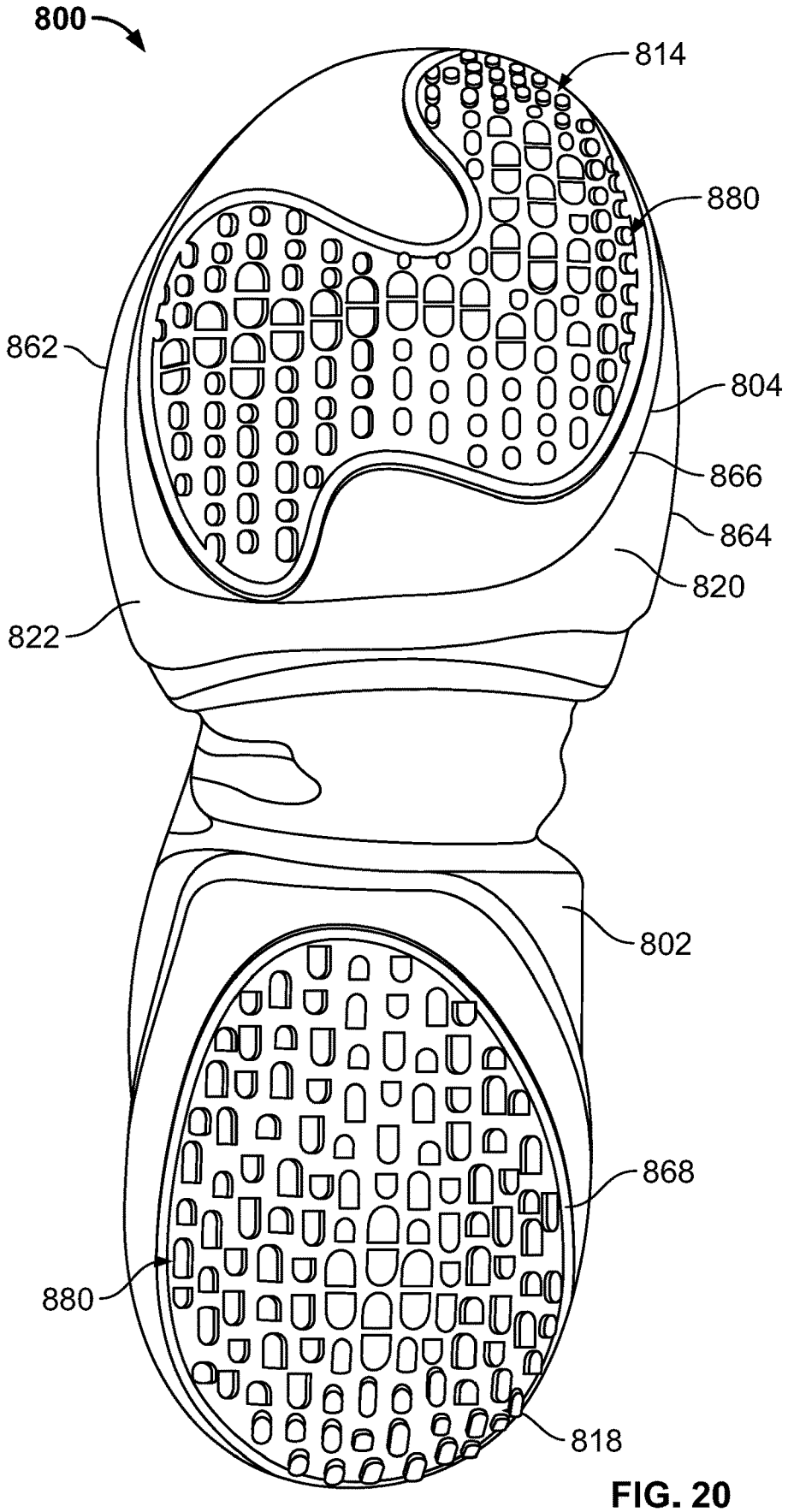
FIG. 20 is a bottom plan view of the article of footwear of FIG. 17.

Furthermore, turning to FIG. 20, the outsole 804 may be characterized by a medial edge 862 disposed along the medial side 822, and a lateral edge 864 disposed along the lateral side 820. The forefoot support surface 866 may substantially cover the forefoot region 814 of the article of footwear 800. Further, the forefoot support surface 866 may include tread 880 on a surface thereof to provide enhanced traction and grip. For example, the forefoot support surface 866 may have a plurality of recesses or channels extending inwardly from that surface and/or a plurality of bumps or pegs extending outwardly therefrom. The heel support surface 868 may substantially cover the heel region 818 of the article of footwear 800. Similarly, the heel support surface 868 may include the tread 880 on a surface thereof to provide enhanced traction and grip. For example, the heel support surface 868 may also include a plurality of recesses or channels extending inwardly from that surface and/or a plurality of bumps or pegs extending outwardly therefrom.

Any of the embodiments described herein may be modified to include any of the structures or methodologies disclosed in connection with different embodiments. Further, the present disclosure is not limited to articles of footwear of the type specifically shown. Still further, aspects of the articles of footwear of any of the embodiments disclosed herein may be modified to work with any type of footwear, apparel, or other athletic equipment.

As noted previously, it will be appreciated by those skilled in the art that while the disclosure has been described above in connection with particular embodiments and examples, the disclosure is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

INDUSTRIAL APPLICABILITY

Numerous modifications to the present disclosure will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved.

We claim:

1. A method for using an article of footwear while sitting in a chair capable of transitioning between at least first, second, and third states, wherein an orientation of the chair is different in each of the at least first, second, and third states, the article of footwear comprising an outsole, the outsole including a medial wrap-up, a lateral wrap-up, and a heel wrap-up, the method comprising:

providing the article of footwear to a user; and providing the chair to the user, wherein the article of footwear is configured to be positioned in a first footwear state while sitting in a chair first state, wherein the article of footwear is configured to be positioned in a second footwear state while sitting in a chair second state, wherein a different amount of force is applied to the medial wrap-up in the first footwear state and the second footwear state such that the medial wrap-up deforms relative to the first footwear state, wherein the article of footwear is configured to be positioned in a third footwear state while sitting in a chair third state, wherein a different amount of force is applied to the heel wrap-up in the first footwear state and the third footwear state such that the heel wrap-up deforms relative to the first footwear state, wherein the article of footwear further comprises a medial side and a lateral side, wherein the outsole further comprises a forefoot support surface, a heel support surface, and a midfoot bridge that connects the forefoot support surface and the heel support surface, and wherein the midfoot bridge is positioned proximate the medial side, and wherein the forefoot support surface, the heel support surface, and the midfoot bridge define a notch proximate the lateral side.

2. The method of claim 1, wherein the chair is a gaming chair, and wherein the gaming chair comprises:

a seat; and first and second legs, the first and second legs extending from the seat, wherein the first leg comprises a first portion, a second portion, and a third portion, a first curved portion connecting the first portion to the second portion, and a second curved portion connecting the second portion to the third portion.

3. The method of claim 2, wherein when the gaming chair is in the first chair state and the article of footwear is in the first footwear state, the first curved portion of the gaming chair contacts the ground.

4. The method of claim 2, wherein when the gaming chair is in the third chair state and the article of footwear is in the third footwear state, the second curved portion of the gaming chair contacts the ground.

5. The method of claim 1, wherein in the first footwear state, the lateral wrap-up deforms relative to the second footwear state.

6. The method of claim 5, wherein, when in the second footwear state, the medial wrap-up receives increased force, relative to the first footwear state, and wherein, when in the third footwear state, the heel wrap-up receives increased force, relative to the first footwear state.

7. A method for using an article of footwear comprising an outsole, the outsole including a medial wrap-up, a lateral wrap-up, and a heel wrap-up, the method comprising:

providing the article of footwear to a user, wherein the article of footwear is configured to be positioned in a first footwear state, wherein the article of footwear is configured to be positioned in a second footwear state, wherein the medial wrap-up receives increased force relative to the first footwear state, wherein the article of footwear is configured to be positioned in a third footwear state, wherein the heel wrap-up receives increased force relative to the first footwear state, wherein when the article of footwear is in the first footwear state, the lateral wrap-up receives increased force relative to the second footwear state, wherein the outsole further includes a forefoot support surface, a heel support surface, and a midfoot bridge, the midfoot bridge connecting the forefoot support surface and the heel support surface, and the midfoot bridge being positioned proximate a medial side of the article of footwear, and wherein the forefoot support surface, the heel support surface, and the midfoot bridge define a notch that extends from the lateral side to the medial side, such that the notch extends across a longitudinal center axis of the article of footwear.

8. The method of claim 7, wherein the article of footwear further comprises a lateral side, and wherein the forefoot support surface, the heel support surface, and the midfoot bridge define a notch proximate the lateral side.

9. The method of claim 7, further including the step of sitting in a chair capable of transitioning between at least first, second, and third chair states, wherein an orientation of the chair is different in each of the at least first, second, and third chair states, and wherein the chair comprises:

a seat; and first and second legs, the first and second legs extending from the seat, wherein the first leg comprises a first portion, a second portion, and a third portion, and wherein a first curved portion connects the first portion to the second portion, and a second curved portion connects the second portion to the third portion.

10. The method of claim 9, wherein when the chair is in the first chair state and the article of footwear is in the first footwear state, the first curved portion of the chair contacts the ground.

11. The method of claim 10, wherein when the chair is in the third chair state and the article of footwear is in the third footwear state, the second curved portion of the chair contacts the ground.

12. The method of claim 7, wherein, when in the second footwear state, the medial wrap-up deforms relative to the first footwear state.

13. The method of claim 7, wherein, when in the third footwear state, the heel wrap-up deforms relative to the first footwear state.

14. A system for use with electronic gaming, comprising:

a gaming chair, the gaming chair comprising a seat, a first leg, and a second leg, the first and second legs extending from the seat, the first leg comprising a first portion, a second portion, and a third portion, a first curved portion connecting the first portion to the second portion, and a second curved portion connecting the second portion to the third portion; and an article of footwear comprising an outsole, the outsole including a medial wrap-up, a lateral wrap-up, and a heel wrap-up, wherein the medial wrap-up, the lateral wrap-up, and the heel wrap-up extend upward from an outer perimeter defined by the remainder of the outsole such that the medial wrap-up, the lateral wrap-up, and the heel wrap-up are configured to surround a portion of a side of a foot of a user, wherein the outsole further includes a forefoot support surface, a heel support surface, and a midfoot bridge, the midfoot bridge connecting the forefoot support surface and the heel support surface, and the midfoot bridge being positioned proximate a medial side of the article of footwear, and wherein the forefoot support surface, the heel support surface, and the midfoot bridge define a notch.

15. A method for using an article of footwear comprising an outsole, the outsole including a medial wrap-up, a lateral wrap-up, and a heel wrap-up, the method comprising:

providing the article of footwear to a user, wherein the article of footwear is configured to be positioned in a first footwear state, wherein the article of footwear is configured to be positioned in a second footwear state, wherein a different amount of force is applied to the medial wrap-up in the first footwear state and the second footwear state such that the medial wrap-up deforms relative to the first footwear state, wherein the article of footwear is configured to be positioned in a third footwear state, wherein the heel wrap-up deforms relative to the first footwear state, wherein when the article of footwear is in the first footwear state, a different amount of force is applied to the heel wrap-up in the first footwear state and the third footwear state such that the lateral wrap-up deforms relative to the second footwear state, wherein the outsole further includes a forefoot support surface, a heel support surface, and a midfoot bridge, the midfoot bridge connecting the forefoot support surface and the heel support surface, and the midfoot bridge being positioned proximate a medial side of the article of footwear, and wherein the forefoot support surface, the heel support surface, and the midfoot bridge define a notch.

16. The method of claim 15, further including the step of sitting in a chair capable of transitioning between at least first, second, and third chair states, wherein an orientation of the chair is different in each of the at least first, second, and third chair states, and wherein the chair comprises:

a seat; and first and second legs, the first and second legs extending from the seat, wherein the first leg comprises a first portion, a second portion, and a third portion, and wherein a first curved portion connects the first portion to the second portion, and a second curved portion connects the second portion to the third portion.

17. The method of claim 16, wherein when the chair is in the first chair state and the article of footwear is in the first footwear state, the first curved portion of the chair contacts the ground.

18. The method of claim 17, wherein when the chair is in the third chair state and the article of footwear is in the third footwear state, the second curved portion of the chair contacts the ground.

* * * * *